US006679588B2

(12) United States Patent
Takahashi

(10) Patent No.: US 6,679,588 B2
(45) Date of Patent: Jan. 20, 2004

(54) PIEZOELECTRIC TRANSDUCER AND INK EJECTOR USING PIEZOELECTRIC TRANSDUCER

(75) Inventor: Yoshikazu Takahashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 119 days.

(21) Appl. No.: 10/095,703

(22) Filed: Mar. 13, 2002

(65) Prior Publication Data

US 2002/0140784 A1 Oct. 3, 2002

(30) Foreign Application Priority Data

Mar. 29, 2001 (JP) ..... 2001-096420
Jan. 29, 2002 (JP) ..... 2002-020335

(51) Int. Cl.[7] ..... B41J 2/045
(52) U.S. Cl. ..... 347/69; 347/72
(58) Field of Search ..... 347/68–72; 310/365, 310/366

(56) References Cited

U.S. PATENT DOCUMENTS 4,584,590 A 4/1986 Fischbeck et al.
4,825,227 A * 4/1989 Fischbeck et al. ..... 347/69
5,266,964 A 11/1993 Takahashi et al.
6,174,051 B1 1/2001 Sakaida
2003/0146956 A1 * 8/2003 Takahashi ..... 347/71

FOREIGN PATENT DOCUMENTS

JP A 10-58675 3/1998

* cited by examiner

*Primary Examiner*—Judy Nguyen
(74) *Attorney, Agent, or Firm*—Oliff & Berridge, PLC

(57) ABSTRACT

A piezoelectric transducer having inner electrodes placed on each laminated piezoelectric ceramic layer. The inner electrodes include a center electrode centered over each ink channel, two end electrodes aligned with partition walls defining each ink channel, and two border electrodes located between the center electrode and the two end electrodes. In each layer, two second areas defined by the two border electrodes and the two end electrodes are polarized in the laminating direction of the ceramic layers. Upon application of a drive voltage to the inner electrodes for a selected ink channel, resultant electric fields cause the two second areas in each layer over the selected ink channel to deform outwardly into parallelogram shapes by a shear effect, and cause two first areas in each layer over the selected ink channel to deform to enhance the deformation of the two second areas.

29 Claims, 21 Drawing Sheets

PIEZOELECTRIC TRANSDUCER AND INK EJECTOR USING PIEZOELECTRIC TRANSDUCER

BACKGROUND OF THE INVENTION

1. Field of Invention

The invention relates to a piezoelectric transducer and an ink ejector using a piezoelectric transducer.

2. Description of Related Art

A piezoelectric ink ejector has been conventionally proposed for a printhead. In a drop-on-demand ink ejector, a piezoelectric transducer deforms to change the volume of an ink channel containing ink. Ink in the ink channel is ejected from a nozzle when the volume is reduced, while ink is drawn into the ink channel when the volume is increased. Typically, a number of such ink ejecting mechanisms are disposed adjacent to each other, and ink is selectively ejected from an ink ejecting mechanism located in a particular position to form desired characters and graphics.

In a conventional piezoelectric ink ejector, one piezoelectric transducer is used for each ink ejecting mechanism. In this case, if a number of ink ejecting mechanisms are clustered to form an image over a wide range at high resolution, the ink ejector becomes complicated in structure and expensive to manufacture. In addition, it is hard to downsize each ejecting mechanism because the piezoelectric transducer cannot be made smaller due to machining constraints. Thus, the resolution is limited in such an ink ejector.

To address the forgoing problems, a single piezoelectric transducer disposed across a plurality of ink channels has recently been proposed for a piezoelectric ink ejector. A portion of the single piezoelectric transducer corresponding to a particular ejecting mechanism is locally deformed. Such a piezoelectric ink ejector is disclosed in U.S. Pat. No. 5,266,964. A piezoelectric ink ejector that has the same operation principle as that disclosed in the above patent is shown in FIGS. 23, 24. A piezoelectric ink ejector 401 includes a piezoelectric transducer 400, an ink channel forming member 60, and a spacer member 70, and a nozzle plate 90 having nozzles 80 connected to holes 71 formed in the spacer member 70.

The Piezoelectric transducer 400 is disposed across a plurality of ink channels 50 to change the volume of each ink channel 50. The piezoelectric transducer 400 is made by laminating a plurality of piezoelectric ceramic layers 410 while sandwiching spaced inner electrodes 430, 440 placed along each piezoelectric ceramic layer.

The piezoelectric ceramic layers 410 are polarized in the laminating direction, as shown by arrows P1. Each column of inner positive electrodes 430 is centered over each ink channel 50, and each column of inner grounded electrodes 440 is placed at either edge of each ink channel 50 (on the upper end face of the ink channel forming member 60).

When an ink droplet is ejected from an ink channel 50 based on a predetermined print data, a drive voltage is applied to the inner grounded electrodes 440, 440 at both edges of the ink channel 50 and to the inner positive electrodes 430 at the center. At this time, electrical fields are generated in the piezoelectric ceramic layers 410 (which form a piezoelectric transducer) symmetrically with respect to the inner positive electrodes 430 and perpendicular to the polarization directions, i.e. parallel to the inner positive electrodes, as shown by dashed arrows E1. As a result, two portions of the piezoelectric transducer on both sides of the inner positive electrodes 430 are deformed into parallelogram shapes by a shear effect, and the inner positive electrodes 430 are shifted upwardly in FIG. 23, thereby increasing the volume of the ink channel 50. At this time, ink is supplied from an ink source (not shown). Thereafter, when the application of the drive voltage is stopped, the deformed piezoelectric transducer returns to its original state. Thus, the volume of the ink channel 50 is reduced, and an ink droplet 81 is ejected from the ink channel 50 through the corresponding nozzle 80.

The ink ejector structured as described above is easy and inexpensive to manufacture and able to accomplish high-resolution printing.

However, in the above-described piezoelectric ink ejector, when the required ink droplet volume and the required ink ejecting velocity are fixed, the required drive voltage is determined by the spaces between inner positive electrodes 430 and their adjacent inner grounded electrodes 440, 440 provided for each ink channel 50. Thus, the drive voltage cannot be lowered as desired, resulting in an increase in the costs of a power source and a driving circuit board. In addition, when the drive voltage is fairly high, the polarization property of the piezoelectric transducer 400 tends to deteriorate due to the drive voltage applying direction and the polarization direction that are perpendicular to each other, which shortens the lifespan of the ink ejector.

When the spaces between inner positive electrodes 430 and their adjacent inner grounded electrodes 440, 440 provided for each ink channel 50 are decreased to lower the drive voltage, locally deformable areas of the piezoelectric transducer 400 are reduced, and the amount of change in the volume of ink in the ink channel 50 is also reduced. Because of such structural limitations, it is hard to decrease the drive voltage.

U.S. Pat. No. 6,174,051 and Japanese Laid-Open Patent Publication No. 10-58675 disclose another piezoelectric transducer, in which a piezoelectric ceramic layer that deforms in a shear mode is laminated on another piezoelectric ceramic layer that deforms in an expansion/contraction mode. The disclosed piezoelectric transducer deforms fairly effectively in combined modes. However, a need for a more effectively deformable piezoelectric transducer still exists.

SUMMARY OF THE INVENTION

The invention provides a piezoelectric transducer that can be effectively deformed with a low voltage and also provides an ink ejector that is driven with a low voltage, has high durability, and can reduce the costs of a power source and a driving circuit board.

According to one aspect of the invention, a piezoelectric transducer includes a piezoelectric ceramic member and a plurality of electrodes spaced along the piezoelectric ceramic member. The plurality of electrodes includes a first set of electrodes defining therebetween at least one first area and a second set of electrodes split by the at least one first area and defining a second area on each side of the at least first area. The two second areas are polarized substantially perpendicular to opposing directions of electrodes of the second set. Upon application of a drive voltage to the first and second sets of electrodes, an electric field is generated in each of the two second areas substantially perpendicular to the polarization direction, and each of the two second areas is obliquely deformed by a piezoelectric shear effect to unidirectionally shift the at least one first area. At the same time, the at least one first area is deformed to increase a space created between the deformed two second areas.

When the above-described piezoelectric transducer is placed across a plurality of ink channels, a first set of electrodes and a second set of electrodes are provided for each ink channel. At least one first area is substantially centered over each ink channel, and two second areas are located near both edges of each ink channel. When at least one first area and two second areas over a selected ink channel are deformed as described above, the volume of the ink channel is changed, causing ink ejection from a nozzle of the selected ink channel.

BRIEF DESCRIPTION OF THE DRAWINGS

Preferred embodiments of the invention will be described in detail with reference to the following figures, in which like elements are labeled with like numbers and the figures are not drawn to scale and in which.

DETAILED DESCRIPTION OF PREFERRED EMBODIMENTS

A first embodiment of the invention of a piezoelectric transducer and an ink ejector will be described with reference to FIGS. 1 through 8.

Figure 1:
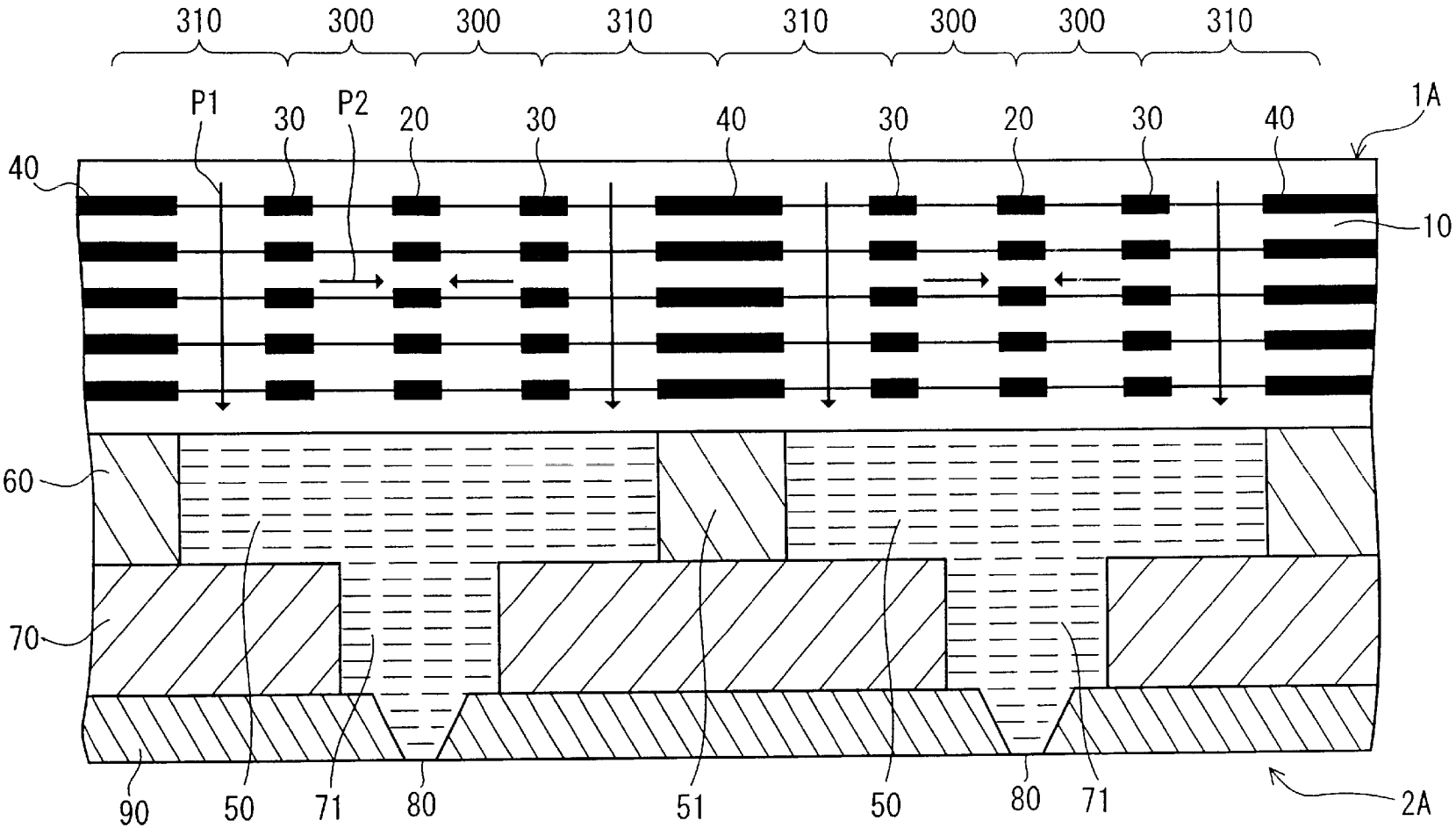
FIG. 1 is a sectional view of an ink ejector according to a first embodiment of the invention.

As shown in FIG. 1, an ink ejector 2A includes a piezoelectric transducer 1A, an ink channel forming member 60, a spacer member 70, and a nozzle plate 90 having nozzles 80.

Ink channels 50, each containing ink, are defined by openings formed in the ink channel forming member 60. The piezoelectric transducer 1A covers the openings from the top, and the spacer member 70 partially covers the openings from the bottom (in the top to bottom directions of FIG. 1). Each ink channel measures 0.375 mm in width (in a right-left direction in FIG. 1) and 2.000 mm in length (in a direction perpendicular to the sheet of FIG. 1). A plurality of ink channels are arranged with 0.508 mm pitches (50 dpi) in the right-left direction in FIG. 1. Each ink channel 50 is connected, at one longitudinal end, to an associated nozzle 80 formed in the nozzle plate 90 through a connecting hole 71 formed in the spacer member 70 and, at the other end, to an ink supply source (not shown).

The piezoelectric transducer 1A is made of a piezoelectric ceramic material of lead zirconate titanate (PZT) group. The piezoelectric transducer 1A includes one or more piezoelectric ceramic layers 10 having a piezoelectric and electrostrictive strain effect and a plurality of spaced inner electrodes 20, 30, 40 placed along each piezoelectric ceramic layer 10.

The inner electrodes 20, 30, 40 are distinguished from each other by their positions in the width direction of each ink channel 50 (in the right-left direction in FIG. 1). Inner electrodes substantially centered over each ink channel 50 are called center electrodes 20. Inner electrodes aligned with each partition wall 51 separating adjacent two ink channels 50 are called end electrodes 40. Inner electrodes located substantially in the middle of adjacent center and end electrodes 20, 40 are called border electrodes 30. Areas in the piezoelectric ceramic layers 10 defined by a first set of electrodes that includes an odd number of columns of electrodes (inner electrodes 30, 20, 30) are called first areas 300. Areas in the piezoelectric ceramic layers 10 defined by a second set of electrodes that includes a plurality of columns of electrodes (inner electrodes 40, 30, 30, 40) split by the first areas 300 are called second areas 310. Column as used herein means electrodes stacked one above another as shown in FIG. 1.

Each piezoelectric ceramic layer 10 measures 0.015 mm in thickness. A total of six piezoelectric ceramic layers are laminated with the inner electrodes 20, 30, 40 interposed therebetween, thereby forming the piezoelectric transducer 1A having a thickness of 0.090 mm.

The inner electrodes 20, 30, 40 are made of a conductive metal of Ag—Pd group and measure about 0.002 mm in thickness. The inner electrodes 20, 30 measure about 0.040 mm in width (in the right-left direction in FIG. 1) while the inner electrodes 40 measure about 0.080 mm in width. The space between adjacent inner electrodes 20, 30 placed in the same plane is about 0.077 mm.

In each ink channel 50, two first areas 300 defined by center electrodes 20 and border electrodes 30, 30 on both sides of the center electrodes 20 are deformed by a longitudinal effect. The polarization directions in the two first areas 300 are parallel to the ink channel width direction (in directions in which the inner electrodes 20, 30 are opposed to each other), as shown by arrows P2 and are symmetrical with respect to the inner center electrodes 20. Additionally, two second areas 310 defined, on both sides of the two first areas 300, by adjacent end and border electrodes 30, 40 are deformed by a shear effect. The polarization directions in the two second areas 310 are parallel to the laminating direction of the piezoelectric ceramic layers 10, as shown by arrows P1. In other words, two central areas deformable by a longitudinal effect and two side areas deformable by a shear effect are formed symmetrically with respect to the center of each ink channel 50.

The piezoelectric transducer 1A is manufactured as described below.

Figure 2:
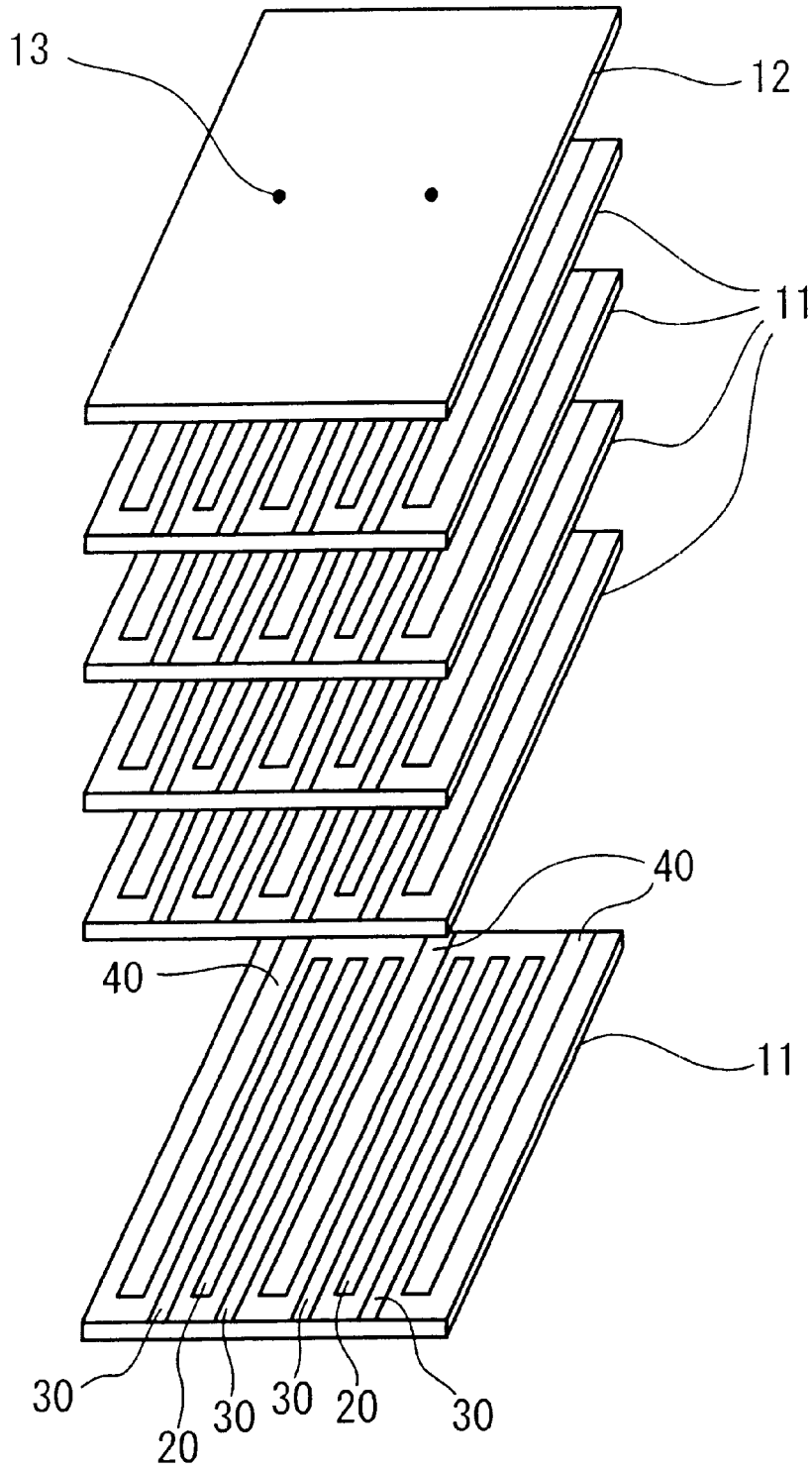
FIG. 2 is a perspective view of ceramic green sheets laminated in a manufacturing procedure of a piezoelectric transducer for the ink ejector according to the first embodiment.

As shown in FIG. 2, discrete inner electrodes 20, 30, 40 are formed on the upper surface of a ceramic green sheet 11 by screen-printing. The inner electrodes 20, 30, 40 vary in shape depending on the direction in which they are led out. Center electrodes 20 are not led to the front or the back, as shown in FIG. 2. Border electrodes 30 sandwiching a center electrode 20 are led to the front. End electrodes 40 sandwiching a center electrode 20 and two border electrodes 30 are led to the back. Five green sheets 11 are prepared as described above and laminated. Then, a green sheet 12 without electrodes is stacked on the top of the laminated green sheets 11.

Through-holes 13 are formed by laser machining through the top green sheet 12 and all the green sheets 11 except for the bottom green sheet 11 to penetrate the center electrodes 20 in the laminating direction (vertically in FIG. 2). The through-holes 13 are filled with an conductive metal of Ag—Pd group to electrically connect the stacked center electrodes 20.

Figure 3:
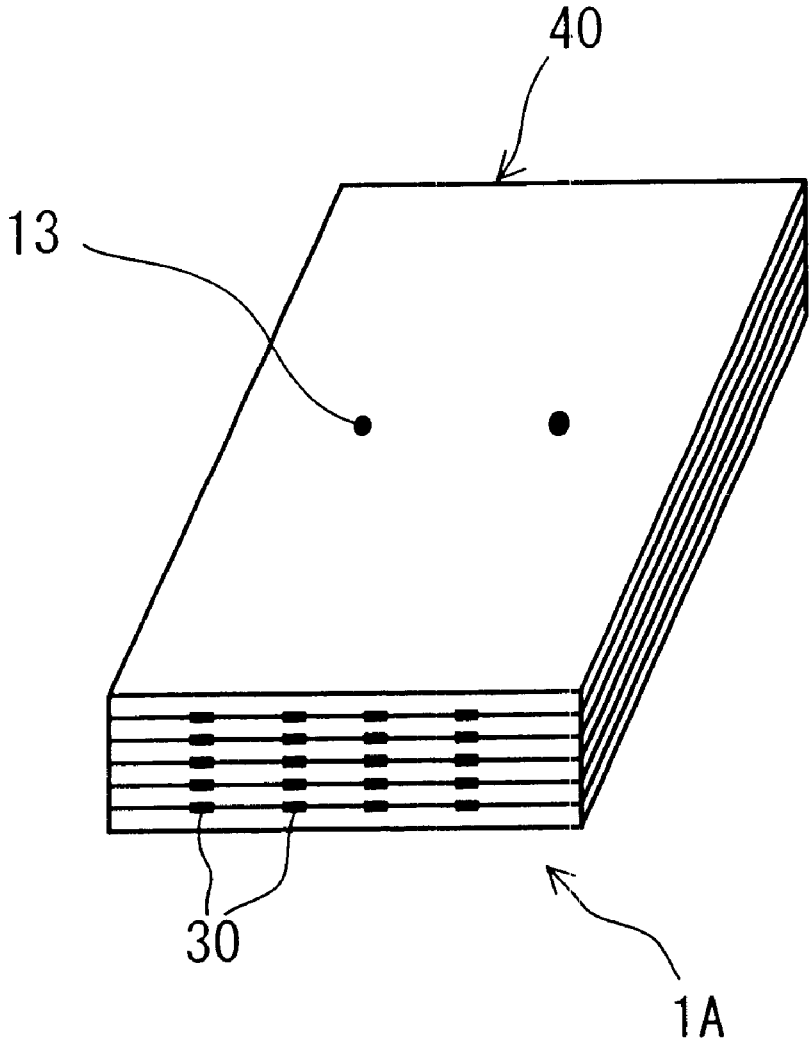
FIG. 3 is a perspective view of piezoelectric sheets laminated and sintered in the manufacturing procedure of the piezoelectric transducer for the ink ejector according to the first embodiment.

Thereafter, the laminated green sheets 11, 12 are thermally pressed and, as is well known, degreased and sintered. As a result, a piezoelectric transducer 1A, shown in FIG. 3, is obtained with the through-holes 13 exposed at the upper surface, the border electrodes 30 exposed at the front, and the end electrodes 40 (not visible) exposed at the back.

Figure 4:
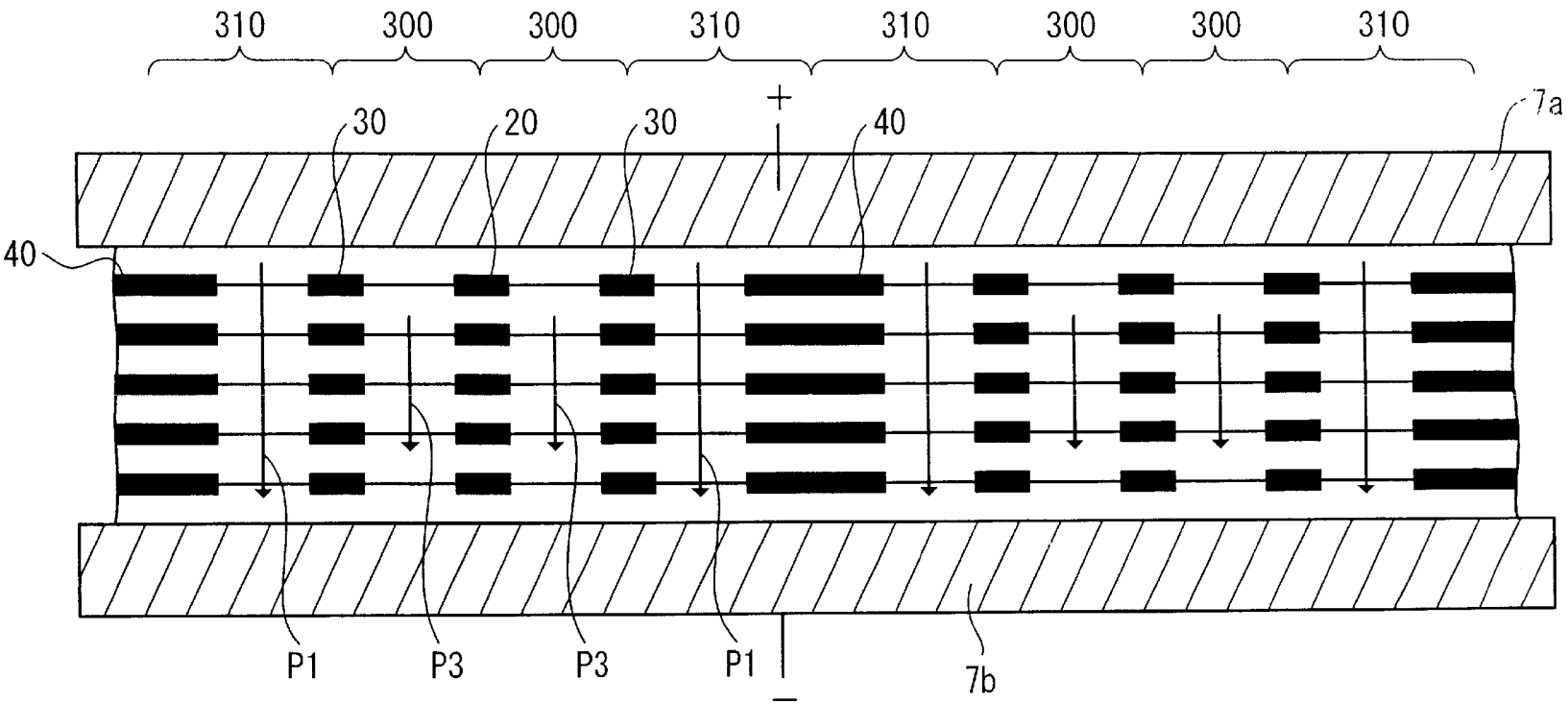
FIG. 4 is a sectional view showing the first polarization in the manufacturing procedure of the piezoelectric transducer for the ink ejector according to the first embodiment.
Figure 5:
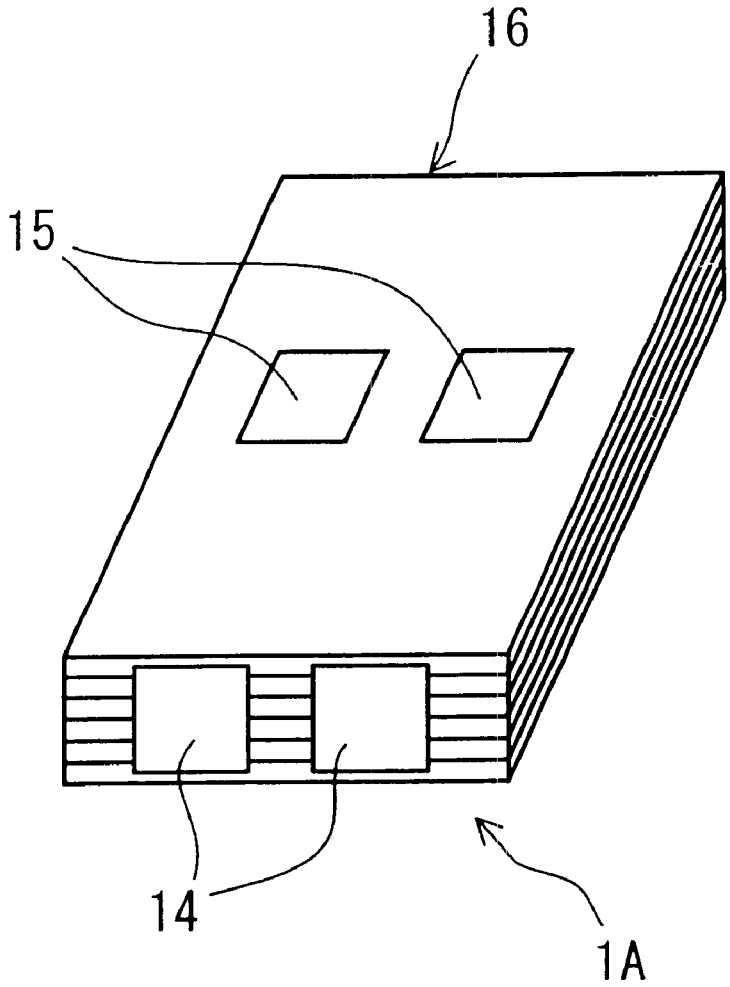
FIG. 5 is a perspective view of the laminated and sintered piezoelectric sheets to which outer electrodes are provided in the manufacturing procedure of the piezoelectric transducer for the ink ejector according to the first embodiment.
Figure 6:
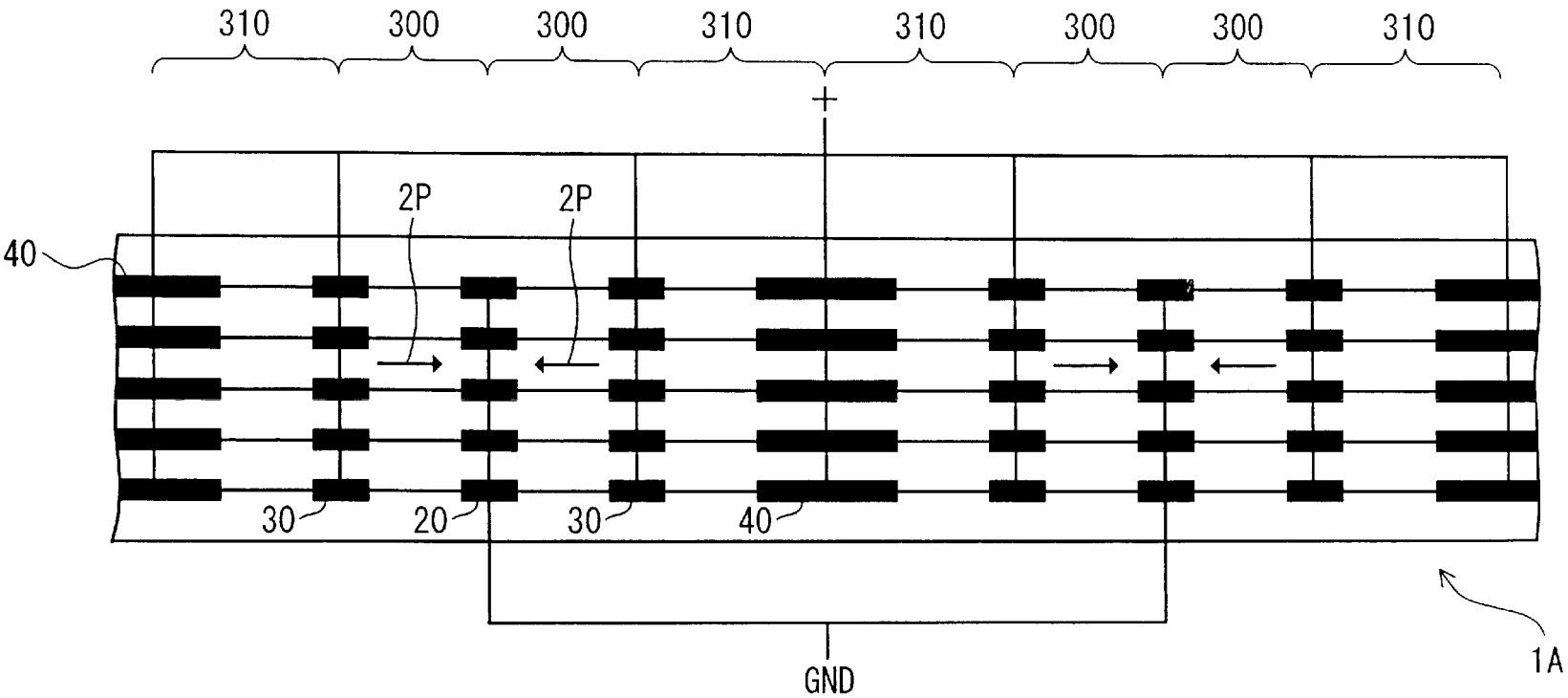
FIG. 6 is a sectional view showing the second polarization in the manufacturing procedure of the piezoelectric transducer for the ink ejector according to the first embodiment.

A positive electrode 7*a* and a negative electrode 7*b* are attached respectively to the upper and lower surfaces of the piezoelectric transducer 1A thus obtained, as shown in FIG. 4. Then, the piezoelectric transducer 1A is immersed in an oil bath filled with an insulating oil, such as a silicon oil, heated to a temperature of about 130° C., and an electric field of about 2.5 kV/mm is applied by a polarizing power source (not shown) between the positive and negative electrodes 7*a*, 7*b* to perform the first polarization. At this time, all the center electrodes 20 are electrically connected to the positive electrode 7*a* via the though-holes 13, while all the border electrodes 30 and all the end electrodes are electrically disconnected. As a result, as shown in FIG. 4, each second area 310 defined between adjacent border and end electrodes 30, 40 is adequately polarized with an electric field of 2.5 kV/mm in the laminating direction (shown by solid arrow P1) of the piezoelectric ceramic layers 10. On the other hand, an electric field is not entirely applied to each first area, which is defined between adjacent center and border electrodes 20, 30, because stacked center electrodes 20 are electrically interconnected in the laminating direction via a through-hole 13. Thus, each first area is polarized more weakly than each second area, in the same direction (shown by solid arrow P3) as the polarization direction in each second area 310 (shown by solid arrow P3).

After the first polarization, the piezoelectric transducer 1A is taken out from the oil bath and the positive and negative electrodes 7*a*, 7*b* are removed therefrom. Then, outer center electrodes 15 are separately formed to electrically connect the through-holes 13 (FIG. 3) exposed at the upper surface of the piezoelectric transducer 1A. Outer border electrodes 14 are formed for electrical connection at the ends of the inner border electrodes 30 (FIG. 3) exposed at the front of the piezoelectric transducer 1A. Each outer border electrode 14 is formed for inner border electrodes 30 provided for each ink channel 50. Likewise, outer end electrodes 16 are formed for electrical connection at the ends of the inner end electrodes 40 (FIG. 3) exposed at the back of the piezoelectric transducer 1A. Each outer end electrode is formed for inner end electrodes 40 provided for each ink channel 50. These outer electrodes 14, 15, 16 are formed by printing and baking silver pastes or spattering them.

Then, the piezoelectric transducer 1A is immersed again in the oil bath (not shown) filled with an insulating oil, such as a silicon oil, heated to a temperature of about 130° C. to perform the second polarization. At this time, all the outer center electrodes 15 are grounded while a positive voltage is applied to all the outer border electrodes 14 and all the outer end electrodes 16. No electric field is applied to any second area defined between adjacent inner border and end electrodes 30, 40, and any second area is not newly polarized. On the other hand, an electric field of 2.5 kV/mm is applied to each first area 300, and adjacent first areas 300 defined by inner center electrodes 20 and inner border electrodes 30, 30 on both sides of the inner center electrodes 20 are polarized symmetrically with respect to the inner center electrodes 20, as shown by solid arrows P2 (in directions in which inner center electrodes 20 and inner border electrodes 30 on both sides of the inner center electrodes 20 are opposed to each other).

By the above-described second polarization, each first area 300 of the piezoelectric transducer 1A is polarized parallel to the ink channel width direction as shown by solid arrow P2 while each second area 310 thereof is polarized parallel to the laminating direction as shown by solid arrow P1. By integrally assembling the ink channel forming member 60, the spacer member 70, and the nozzle plate 90 into the piezoelectric transducer 1A thus obtained, an ink ejector 2A, shown in FIG. 1, is constructed.

The operation of the ink ejector 2A thus structured will be described. In the initial sate, as shown in FIG. 1, all the inner electrodes 20, 30, 40 are grounded and the ink channels 50 are filled with ink.

Figure 7:
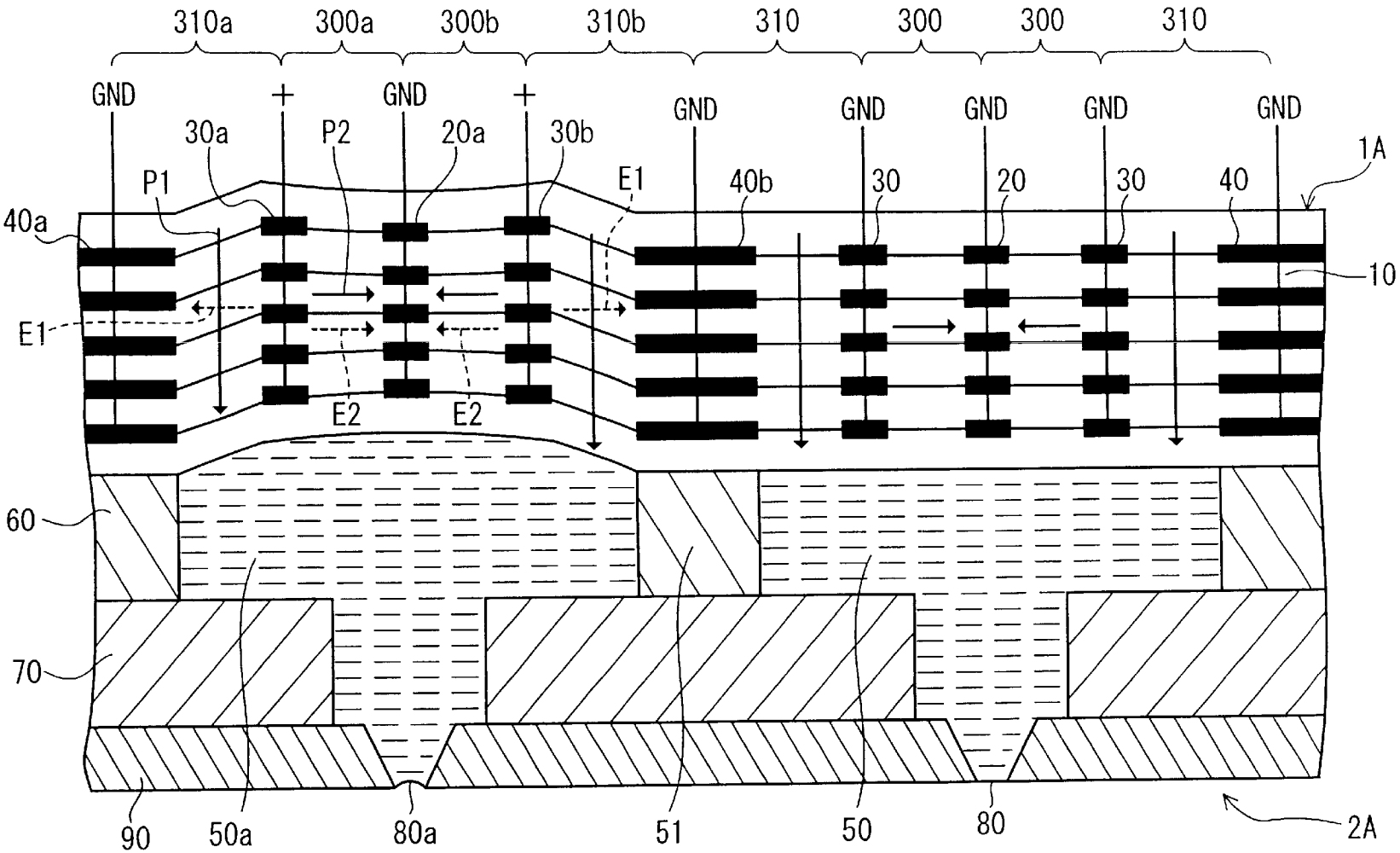
FIG. 7 is a sectional view showing the operation of the ink ejector according to the first embodiment where the piezoelectric transducer is locally deformed.

As shown in FIG. 7, when an ink droplet is ejected from a nozzle 80*a* connected to a selected ink channel 50*a* according to a predetermined print data, a drive voltage (of 15 V, for example) is applied to inner border electrodes 30*a*, 30*b* provided over the selected ink channel 50*a* while other inner electrodes are grounded. In each of areas defined by inner center electrodes 20*a* centered over the ink channel 50*a* and the inner border electrodes 30*a*, 30*b*, an electric field is generated, as shown by dashed arrow E2, parallel to the polarization direction shown by solid arrow P2 (in the direction in which the inner center electrodes 20*a* and the inner border electrodes 30*a*, 30*b* are opposed to each other). An electric field is also generated, as shown by dashed arrow E1, in each of areas between the inner border electrodes 30*a* and inner end electrodes 40*a* and between the inner border electrodes 30*b* and inner end electrodes 40*b*.

Thus, the electric field E1 perpendicular to the polarization direction P1 is applied to each of two second areas 310*a*, 310*b* (areas deformable by a shear effect) provided over the ink channel 50*a*. Each of the second areas 310*a*, 310*b* is deformed, by a piezoelectric and electrostrictive shear effect, into a parallelogram shape and shifted outwardly from the ink channel 50*a* to increase the volume of the ink channel 50*a*. In other words, upon the application of the electric field E1 perpendicular to the polarization direction P1 to each of the second areas 310*a*, 310*b*, the second areas 310*a*, 310*b* are deformed to shift the inner border electrodes 30*a*, 30*b* obliquely with respect to the inner end electrodes 40*a*, 40*b*, thereby shifting the first areas 300*a*, 300*b* away from the nozzle 80*a*.

At the same time, an electric field parallel to the polarization direction P2 is applied to each of the first areas 300*a*, 300*b*. The first areas 300*a*, 300*b* expand in the width direction of the ink channel 50*a* to push opposed ends of the obliquely deformed second areas 310*a*, 310*b*. As a result, the second areas 310*a*, 310*b* (areas deformable by a shear effect) are further deformed outwardly from the ink channel 50*a*. In addition, upon the application of the electric field E2 parallel to the polarization direction P2 to each of the first areas 300*a*, 300*b*, the first areas 300*a*, 300*b* contract in the laminating direction by a transversal effect to further increase the volume of the ink channel 50*a*. In other words, the first areas 300*a*, 300*b* are deformed to increase a space created between the obliquely deformed second areas 310*a*, 310*b*.

At this time, the pressure in the ink channel 50*a* is reduced. By maintaining such a state for a period of time T required for a pressure wave generated to propagate along the ink channel 50*a*, ink is supplied from the ink supply source (not shown).

The one-way propagation time T represents a time required for a pressure wave in the ink channel 50*a* to propagate longitudinally (in a direction perpendicular to the sheet of FIG. 7) along the ink channel 50*a*, and is given by an expression T=L/Z, where L is a length of the ink channel 50*a* and Z is a speed of sound in the ink in the ink channel 50*a*.

Figure 8:
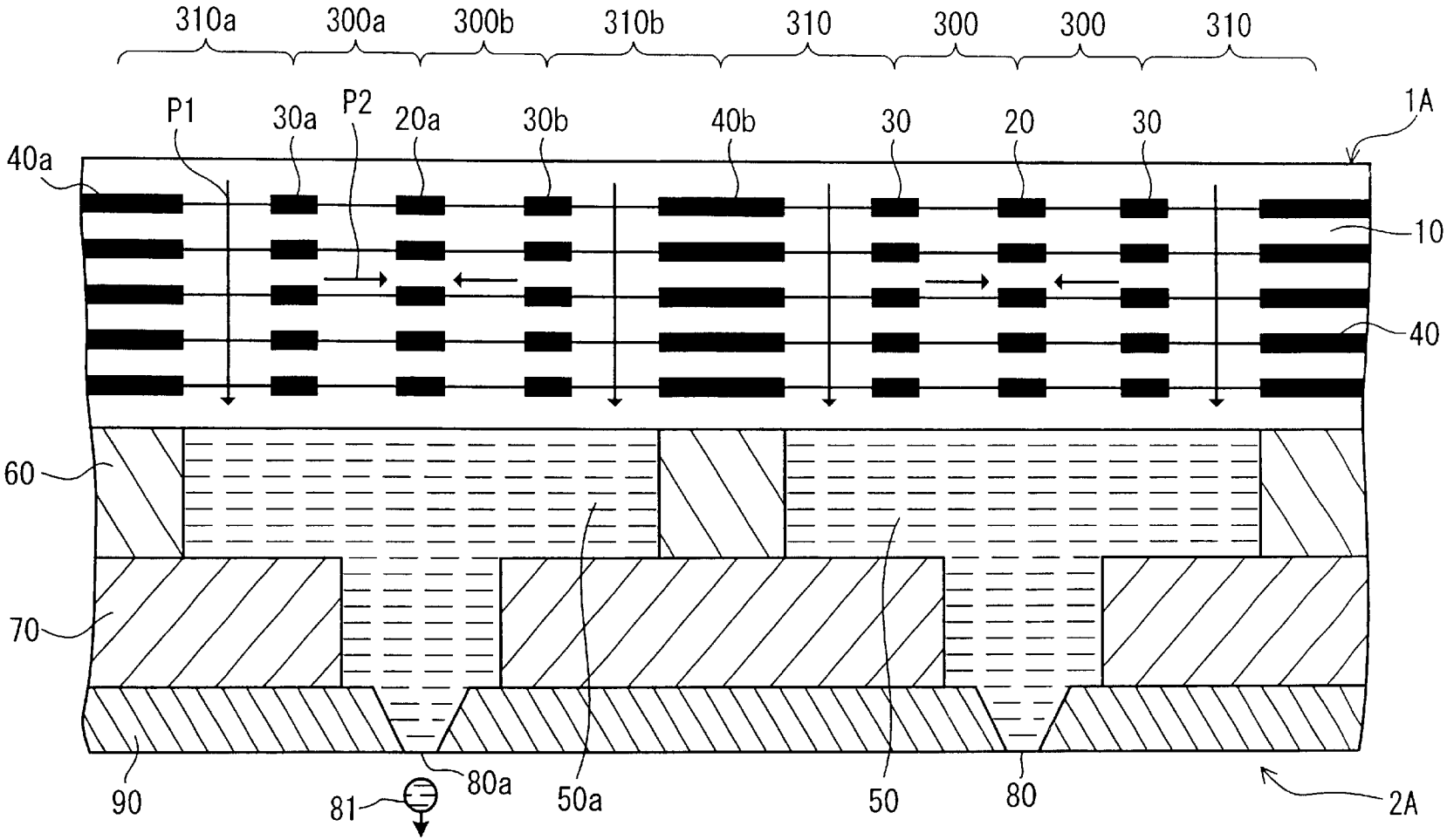
FIG. 8 is a sectional view showing the operation of the ink ejector according to the first embodiment where an ink droplet is ejected.

According to the theory of propagation of a pressure wave, when the time T has expired after the application of the drive voltage, the pressure in the ink channel 50*a* is reversed to a positive pressure. Concurrently with the reversing of the pressure, the voltage applied to the inner border electrodes 30*a*, 30*b* are reset to 0 V. Consequently, as shown in FIG. 8, the piezoelectric transducer 1A returns to its non-deformed original state and pressurizes the ink in the ink channel 50*a*. At this time, the pressure reversed to a positive pressure is combined with the pressure generated upon returning of the piezoelectric transducer 1A, and a relatively high pressure is generated in the vicinity of the nozzle 80*a* of the ink channel 50*a*. As a result, an ink droplet 81 is ejected from the nozzle 80*a*.

In the ink ejector 2A according to the embodiment, because the inner electrodes 20, 30, 40 are formed on and above the bottom layer of the piezoelectric transducer 1A, the inner electrodes 20, 30, 40 are insulated from the ink in the ink channels 50 and prevented from corroding. In addition, because the inner electrodes 20, 30, 40 are sandwiched by adjacent layers, a breakdown of the piezoelectric transducer 1A due to electric discharge between electrodes of opposite polarity is reliably prevented.

As described above, when the piezoelectric transducer 1A is deformed upon the application of the drive voltage, deformation of the second areas 310*a*, 310*b* by a shear effect as well as deformation of the first areas 300*a*, 300*b* by longitudinal and transversal effects contribute the increase in the volume of the ink channel 50*a*. Thus, a high pressure can be generated with a relatively low drive voltage in the vicinity of the nozzle 80*a* connected to the ink channel 50*a*, and the ink ejecting velocity can be increased. In addition, because the spaces between inner electrodes are shortened, the drive voltage can be lowered. Specifically, the drive voltage can be lowered to about half to obtain the conventional level of ink ejecting velocity. Thus, the cost of a driving power source can be reduced.

Although, in the first embodiment, two first areas 300 are provided symmetrically with respect to inner center electrodes 20, only a single first area may be provided, instead. In this case, two second areas 310 on both sides of the single first area 300 should be polarized in opposite directions and, if the polarization direction is reversed in either of the two first areas 310, the direction of an electric field should be reversed there. However, it is advantageous for voltage application and wiring to provide two first areas 300 symmetrically with respect to inner center electrodes 20, as in the first embodiment.

Figure 9:
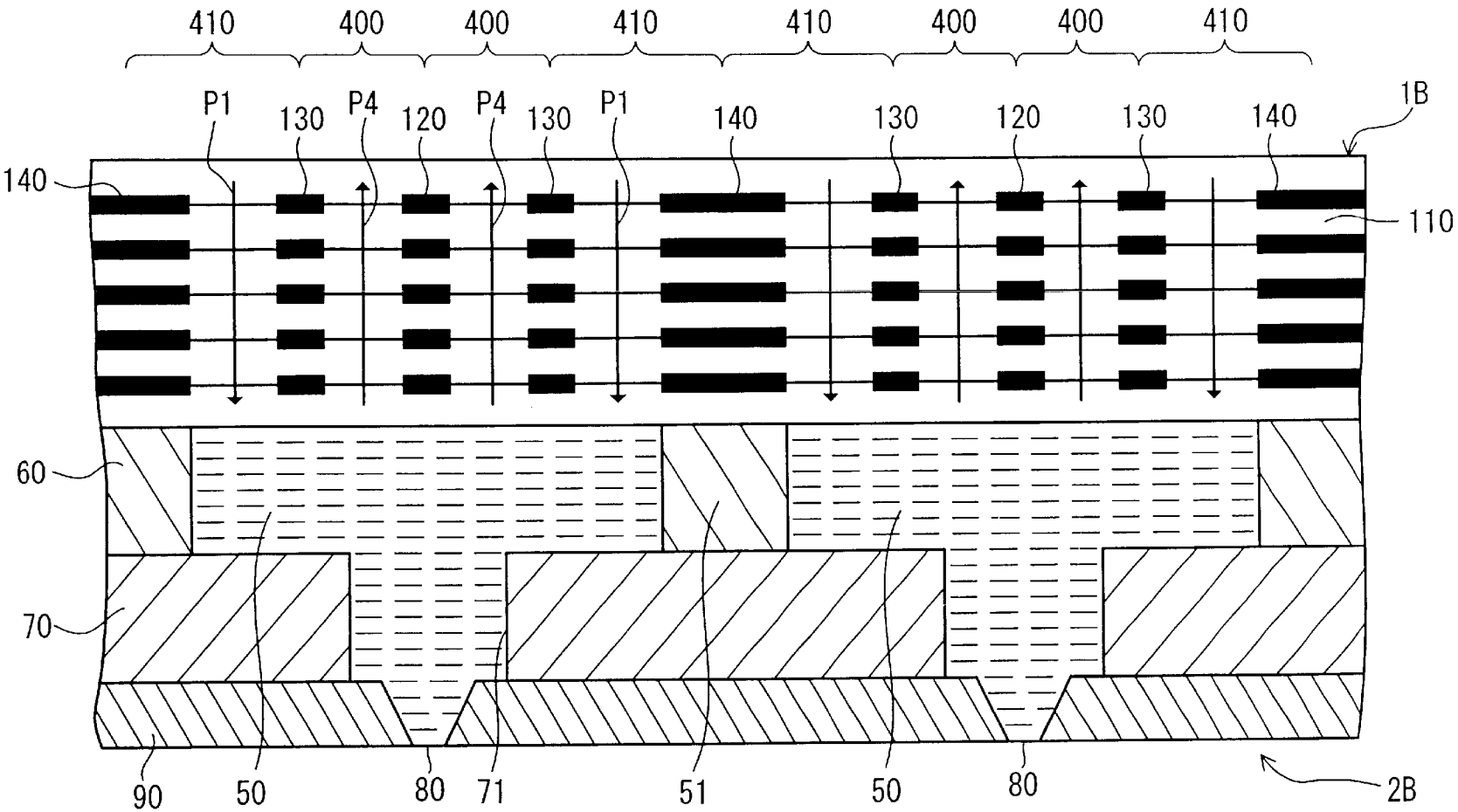
FIG. 9 is a sectional view of an ink ejector according to a second embodiment of the invention.

Referring now to FIGS. 9 through 16, a second embodiment of the invention will be described. As shown in FIG. 9, an ink ejector 2B includes a piezoelectric transducer 1B, an ink channel forming member 60, a spacer member 70, and a nozzle plate 90 having nozzles 80. Each ink channel 50 enclosed by the ink channel forming member 60, the spacer member 70, and the nozzle plate 90 measures 0.450 mm in width (in a right-left direction in FIG. 9) and 2.000 mm in length (in a direction perpendicular to the sheet of FIG. 9). A plurality of ink channels are arranged with 0.508 mm pitches (50 dpi) in the right-left direction in FIG. 9.

The piezoelectric transducer 1B is made of a piezoelectric ceramic material of lead zirconate titanate (PZT) group. The piezoelectric transducer 1B includes one or more piezoelectric ceramic layers 110 having a piezoelectric and electrostrictive strain effect and a plurality of spaced inner electrodes 120, 130, 140 placed along each piezoelectric ceramic layer 110.

The inner electrodes 120, 130, 140 are distinguished from each other by their positions in the width direction of an ink channel 50 (in the right-left direction in FIG. 9). Inner electrodes substantially centered over each ink channel 50 are called center electrodes 120. Inner electrodes aligned with each partition wall 51 separating adjacent two ink channels 50 are called end electrodes 140. Inner electrodes located substantially in the middle of adjacent center and end electrodes 120, 140 are called border electrodes 130. Areas in the piezoelectric ceramic layers 110 defined by a first set of electrodes that includes an odd number of columns of electrodes (inner electrodes 130, 120, 130) are called first areas 400. Areas in the piezoelectric ceramic layers 110 defined by a second set of electrodes that includes a plurality of columns of electrodes (inner electrodes 140, 130, 130, 140) split by the first areas 400 are called second areas 410.

Thus, in the piezoelectric transducer 1B, two first areas 400 are centered over each ink channel 50, and two second areas 410 on both sides of the two first areas 400 are located near both edges of each ink channel 50.

Each piezoelectric ceramic layer 1B measures 0.015 mm in thickness. A total of six piezoelectric ceramic layers are laminated with the inner electrodes 120, 130, 140 interposed therebetween, thereby forming the piezoelectric transducer 1B having a thickness of 0.090 mm.

The inner electrodes 120, 130, 140 are made of an conductive metal of Ag—Pd group and measure about 0.002 mm in thickness. The inner electrodes 120, 130 measure about 0.012 mm in width (in the right-left direction in FIG. 9) while the inner electrodes 140 measure about 0.058 mm in width.

As shown in FIG. 9, the polarization direction in each first area 400 is parallel to the laminating direction of the piezoelectric ceramic layers 110, as shown by solid arrow P4. The polarization direction in each second area 410 is parallel to the laminating direction, as shown by solid line P1, but opposite to the polarization direction (shown by solid arrow P4) in each first area 400.

The piezoelectric transducer 1B according to the second embodiment is manufactured as described below.

Figure 10:
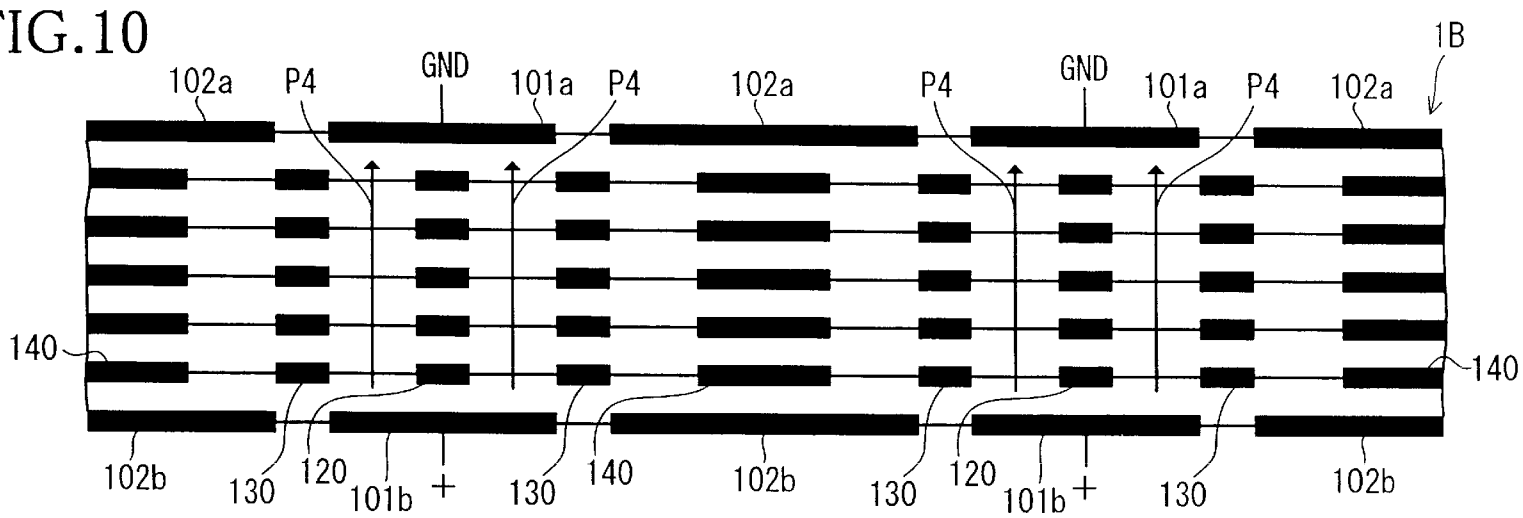
FIG. 10 is a sectional view showing the first polarization in the manufacturing procedure of the piezoelectric transducer for the ink ejector according to the second embodiment.

As in the first embodiment, discrete inner electrodes 120, 130, 140 are formed on the upper surface of each green sheet by screen-printing. Then, the required number of green sheets with inner electrodes 120, 130, 140 are laminated, and a green sheet without inner electrodes is stacked on the top of the laminate. The piezoelectric ceramic layers 1B thus obtained are thermally pressed, degreased, and sintered, as required. Then, outer border electrodes (not shown) are formed to electrically connect stacked inner border electrodes 130 in the same manner as for the inner border electrodes 30 in the first embodiment. Thereafter, as shown in FIG. 10, first polarizing electrodes 101*a*, 101*b* and second polarizing electrodes 102*a*, 102*b* are formed on the upper and lower surfaces of the piezoelectric transducer 1B, by screen-printing or spattering, for first areas 400 and second areas 410, respectively. Each column of inner center electrodes 120 is aligned with the center of each pair of first polarizing electrodes 101*a*, 101*b*, and each column of end inner electrodes 140 is aligned with the center of each pair of second polarizing electrodes 102*a*, 102*b*.

The piezoelectric transducer 1B thus obtained is immersed in an oil bath filled with an insulating oil, such as a silicon oil, heated to a temperature of about 130° C., and an electric field of about 2.5 kV/mm is applied by a polarizing power source (not shown) between each pair of first polarizing electrodes 101*a*, 101*b*. More specifically, as shown in FIG. 10, the first polarization is performed, by grounding all the first polarizing electrodes 101*a* on the upper surface while applying a positive voltage to all the first polarizing electrodes 101*b* on the lower surface. At this time, no voltage is applied to any pair of second polarizing electrodes 102*a*, 102*b*.

Figure 11:
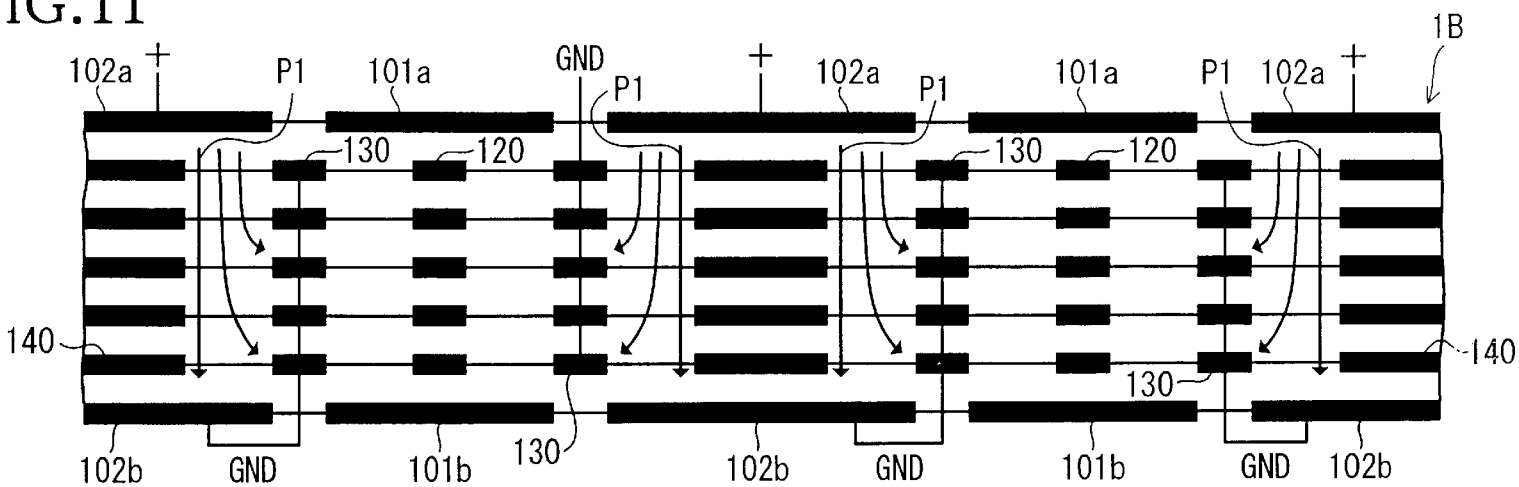
FIG. 11 is a sectional view showing the second polarization in the manufacturing procedure of the piezoelectric transducer for the ink ejector according to the second embodiment.

As a result of the first polarization, an area between each pair of first polarizing electrodes 101*a*, 101*b* is polarized parallel to the laminating direction (upwardly in FIG. 10), as shown by solid arrow P4. Again, the piezoelectric transducer 1B is immersed in an oil bath filled with an insulating oil, such as a silicon oil, heated to a temperature of about 130° C., and an electric field of about 2.5 kV/mm is applied, as shown in FIG. 11, by the polarizing power source (not shown) between each pair of second polarizing electrodes 102*a*, 102*b*. The voltage applying direction is opposite to that for each pair of first polarizing electrodes 101*a*, 101*b* in the first polarization. More specifically, the second polarization is performed, as shown in FIG. 11, by applying a positive voltage to all the second polarizing electrodes 102*a* on the upper surface while grounding all the second polarizing electrodes 102*b* on the lower surface. At this time, all the inner border electrodes 130 are grounded via the outer border electrodes (not shown), and no voltage is applied to any pair of first polarizing electrodes 101*a*, 101*b* to prevent deterioration of the polarization property therebetween.

As a result of the second polarization, an area between each pair of second polarizing electrodes 102*a*, 102*b* is polarized substantially in the laminating direction, as shown by solid arrow P1. Because all the inner border electrodes 130 are grounded during the second polarization, polarization is also performed in directions toward the corresponding inner border electrodes 130.

Figure 12:
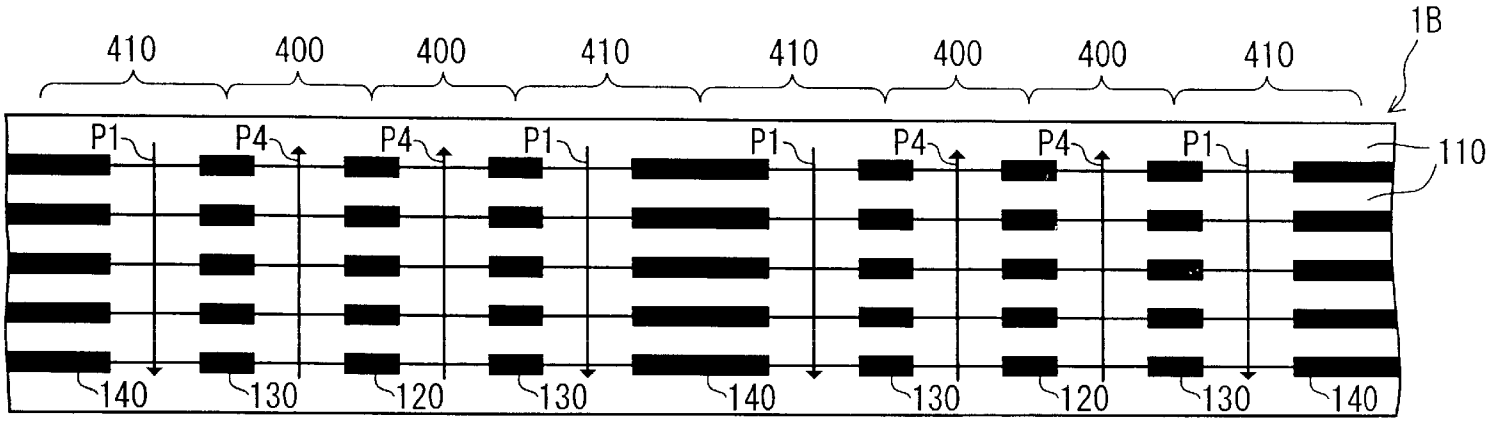
FIG. 12 is a sectional view showing an upper/lower polarizing electrode removing process in the manufacturing procedure of the piezoelectric transducer for the ink ejector according to the second embodiment.

Then, as shown in FIG. 12, the first polarizing electrodes 101*a*, 101*b*, and the second polarizing electrodes 102*a*, 102*b* are removed by grinding from the upper and lower surfaces of the piezoelectric transducer 1B. Areas defined by a column of inner center electrodes 120 and two columns of inner border electrodes 130, 130 on both sides of a column of inner center electrodes 120 become the above-described first areas 400. Areas provided on both sides of the first areas 400 and each defined by a column of inner border electrodes 130 and a column of inner end electrodes 140 become the above-described second areas 410. The polarization direction P4 in each first area 400 is opposite to the polarization direction P1 in each second area 410.

Thereafter, electrical connections are established for stacked inner electrodes 120, 140 in the same manner as for the inner electrodes 20, 40 in the first embodiment.

By integrally assembling the ink channel forming member 60, the spacer 70, and the nozzle plate 90 into the piezoelectric transducer 1B thus obtained, an ink ejector 2B, shown in FIG. 9, is constructed.

Figure 13:
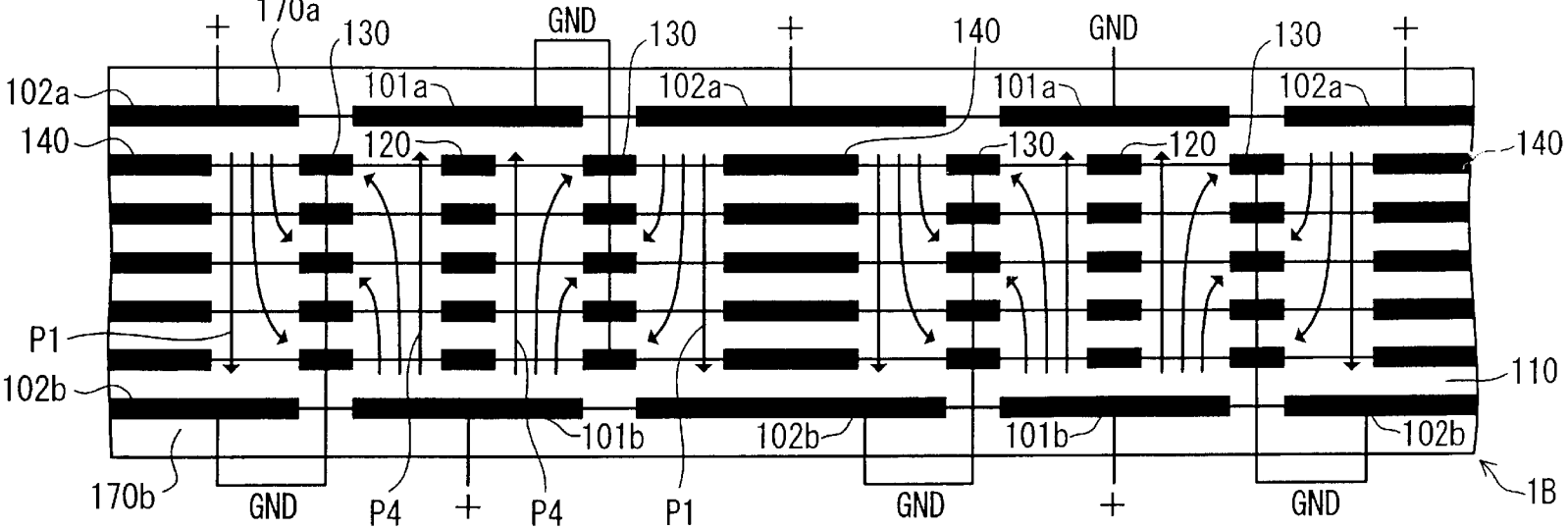
FIG. 13 is a sectional view showing alternate polarization in the manufacturing procedure of the piezoelectric transducer for the ink ejector according to the second embodiment.

The piezoelectric transducer 1B according to the second embodiment can be polarized by an alternative method, as shown in FIG. 13. Discrete inner electrodes 120, 130, 140 are formed on the upper surface of each green sheet by screen-printing. Then, the required number of green sheets with inner electrodes 120, 130, 140 are laminated, and a green sheet without inner electrodes is stacked on the top of the laminate. Then, outer border electrodes (not shown) are formed to electrically connect stacked inner border electrodes 130 in the same manner as for the inner border electrodes 30 in the first embodiment.

Polarizing inner electrodes 101*a*, 102*a* and polarizing inner electrodes 101*b*, 102*b* are formed on one side of a top polarizing green sheet 170*a* and on one side of a bottom polarizing green sheet 170*b*, respectively, by screen-printing. Through-holes (not shown) are formed, similarly to the first embodiment, through the polarizing green sheets

170*a,* 170*b* and filled with an conductive metal of Ag—Pd group in order to electrically lead out the polarizing electrodes 101*a,* 102*a* to the upper surface of the top green sheet 170*a* and to electrically lead out the polarizing electrodes 101*b,* 102*b* to the lower surface of the bottom green sheet 170*b*. Then, outer electrodes (not shown) are formed on the upper surface of the top green sheet 170*a* and on the lower surface of the bottom green sheet 170*b* to contact the through-holes filled with a conductive material.

As shown in FIG. 13, each column of inner center electrodes 120 is aligned with the center of each pair of first polarizing electrodes 101*a,* 101*b,* and each column of end inner electrodes 140 is aligned with the center of each pair of second polarizing electrodes 102*a,* 102*b*.

Then, the polarizing green sheets 170*a,* 170*b* are attached to the top and bottom of the laminated green sheets 110, respectively, such that the first polarizing electrodes 101*a,* 102*b* and the second polarizing electrodes 101*b,* 102*b* are sandwiched by green sheets. The laminate thus obtained is thermally pressed, degreased, and sintered, as required.

The piezoelectric transducer 1B thus obtained is immersed in an oil bath filled with an insulating oil, such as a silicon oil, heated to a temperature of about 130° C., and an electric field of about 2.5 kV/mm is applied by a polarizing power source (not shown) between each pair of first polarizing electrodes 101*a,* 101*b*. More specifically, as shown in FIG. 13, the first polarization is performed, by grounding each first polarizing electrode 101*a* beneath the top green sheet 170*a* while applying a positive voltage to each first polarizing electrode 101*b* on the bottom green sheet 170*b*. At this time, an electric field of about 2.5 kV/mm is applied by a polarizing power source (not shown) between each pair of second polarizing electrodes 102*a,* 102*b* in a direction opposite to that for each pair of first polarizing electrodes 101*a,* 101*b*. More specifically, as shown in FIG. 13, a positive voltage is applied to all the second polarizing electrodes 102*a* beneath the top green sheet 170*a* while all the second polarizing electrodes 102*b* on the bottom green sheet 170*b* are grounded. At this time, all the inner border electrodes 130 are grounded.

As a result of polarization, an area between each pair of first polarizing electrodes 101*a,* 101*b* is polarized parallel to the laminating direction (upwardly in FIG. 13), as shown by solid arrow P4. Because all the inner border electrodes 130 are grounded as described above, polarization is also performed in directions toward the corresponding inner border electrodes 130. Additionally, an area between each pair of first polarizing electrodes 102*a,* 102*b* is polarized parallel to the laminating direction as shown by solid arrow P1. Because all the inner border electrodes 130 are grounded as described above, polarization is also performed in directions toward the corresponding inner border electrodes 130.

Then, the top and bottom green sheets 170*a,* 170*b* as well as the first and second polarizing electrodes 101*a,* 101*b,* 102*a,* 102*b* are removed by grinding from the piezoelectric transducer 1B, and the upper and lower surfaces of the piezoelectric transducer 1B are grounded, as shown in FIG. 12. Accordingly, distortion due to polarization is eliminated from the piezoelectric transducer 1B, and better contact with the ink chamber forming member 60 and outer electrodes to be mounted thereon as well as uniform local deformation of the piezoelectric transducer 1B are ensured.

Areas defined by a column of inner center electrodes 120 and two columns of inner border electrodes 130, 130 on both sides of a column of inner center electrodes 120 become the above-described first areas 400. Areas provided on both side of the first areas and each defined by a column of inner border electrodes 130 and a column of inner end electrodes 140 become the above-described second areas 410. The polarization direction P4 in each first area is opposite to the polarization direction P1 in each second area 410. Because an electric field is simultaneously applied to each first and second area, polarization can be quickly performed.

Thereafter, electrical connections are established for stacked inner electrodes 120, 140 in the same manner as for the inner electrodes 20, 40 in the first embodiment.

Figure 14:
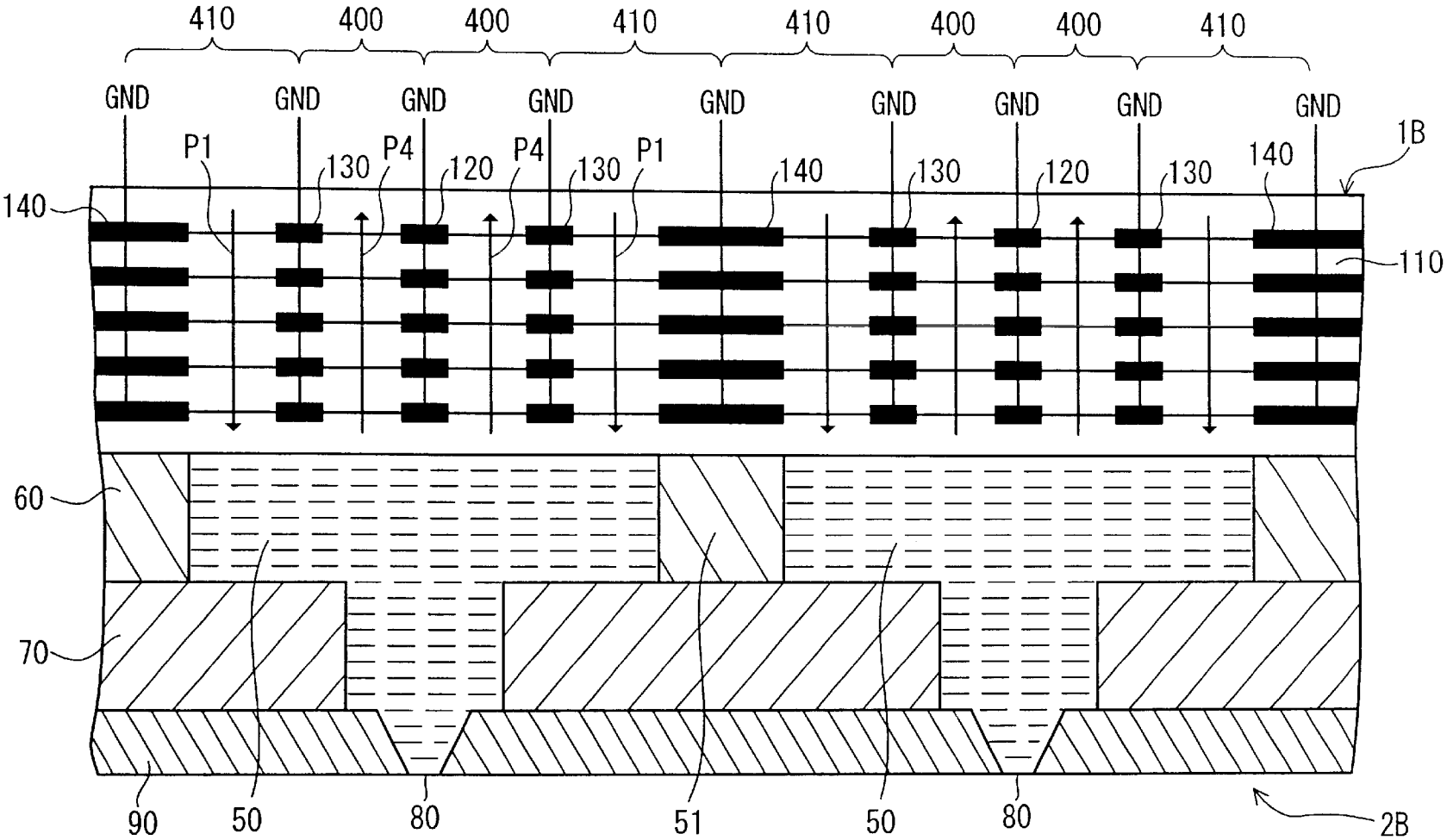
FIG. 14 is a sectional view showing the operation of the ink ejector according to the second embodiment where the ink ejector is in the initial state.

The operation of the ink ejector 2B thus structured will be described. In the initial state, as shown in FIG. 14, all the inner electrodes 120, 130, 140 are grounded and the ink channels 50 are filled with ink.

Figure 15:
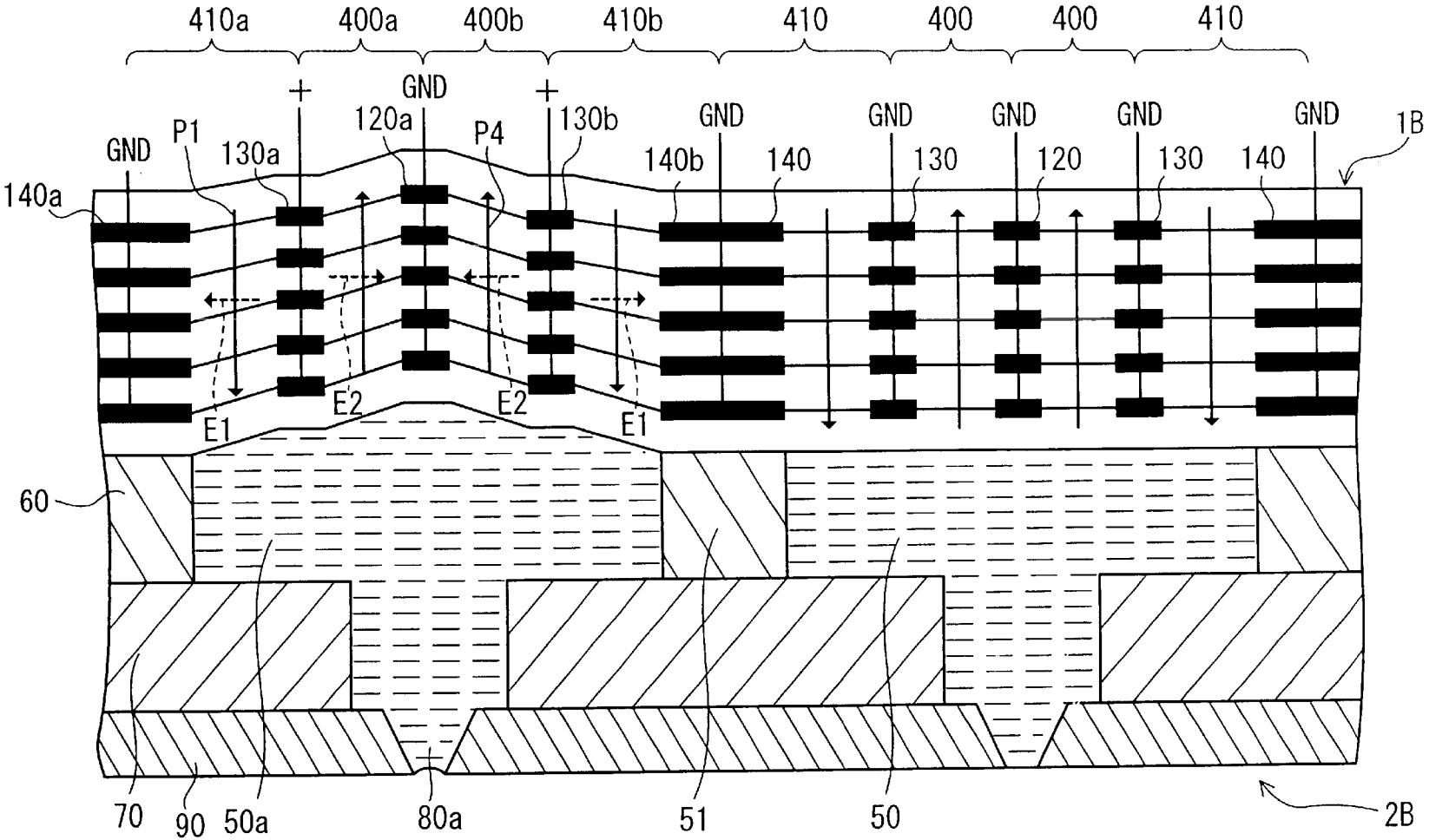
FIG. 15 is a sectional view showing the operation of the ink ejector according to the second embodiment where the piezoelectric transducer is locally deformed.

As shown in FIG. 15, when an ink droplet is ejected from a nozzle 80*a* connected to a selected ink channel 50*a* according to a predetermined print data, a drive voltage (of 15 V, for example) is applied to inner border electrodes 130*a,* 130*b* that are provided over the selected ink channel 50*a*. At this time, an electric field is generated, as shown by dashed arrow E2, perpendicular to the polarization direction P4 in each of first areas 400*a,* 400*b* defined by inner center electrodes 120*a* centered over the ink channel 50*a* and the inner border electrodes 130*a,* 130*b*. An electric field is also generated, as shown by dashed arrow E1, perpendicular to the polarization direction P1 in each of second areas 410*a,* 410*b* defined between the inner border electrodes 130*a* and inner end electrodes 140*a* and between the inner border electrodes 130*b* and inner end electrodes 140*b,* respectively. As a result, an electric field perpendicular to the polarization direction is applied to each of the first and second areas 400*a,* 400*b,* 410*a,* 410*b* defined over the ink channel 50*a* to cause each of these areas to be deform upwardly in FIG. 15 by a piezoelectric shear effect.

Thus, in the first areas 400*a,* 400*b,* electric fields E2 are directed toward the inner center electrodes 120*a,* and in the second areas 410*a,* 410*b,* electric fields E1 are directed toward both edges of the ink channel 50*a*. Each of the second areas 410*a,* 410*b* is deformed, by a piezoelectric and electrostrictive shear effect, into a parallelogram shape and shifted outwardly from the ink channel 50*a* to increase the volume of the ink channel 50*a*. In other words, upon the application of the electric field E1 perpendicular to the polarization direction P1 to each of the second areas 410*a,* 410*b,* the second areas 410*a,* 410*b* are deformed to shift the inner border electrodes 130*a,* 130*b* obliquely with respect to the inner end electrodes 140*a,* 140*b,* thereby shifting the first areas 400*a,* 400*b* away from the nozzle 80*a*. At the same time, the first areas 400*a,* 400*b* defined by the inner center electrodes 120*a* and the inner border electrodes 130*a,* 130*b* are deformed, symmetrically with respect to the inner center electrodes 120*a,* into parallelogram shapes to shift the inner center electrodes 120*a* outwardly from the ink channel 50*a,* thereby increasing the volume of the ink channel 50*a*.

As described above, a portion of the piezoelectric transducer 1B corresponding to the ink channel 50*a* is locally deformed to increase the volume of the ink channel 50*a*. At this time, the pressure in the ink channel 50*a* is reduced. By maintaining such a state for a period of time T required for a pressure wave generated to propagate along the ink channel 50*a,* ink is supplied from the ink supply source (not shown).

The one-way propagation time T represents a time required for a pressure wave in the ink channel 50*a* to propagate longitudinally (in a direction perpendicular to the sheet of FIG. 15) along the ink channel 50*a,* and is given by an expression T=L/Z, where L is a length of the ink channel 50*a* and Z is a speed of sound in the ink in the ink channel 50*a*.

Figure 16:
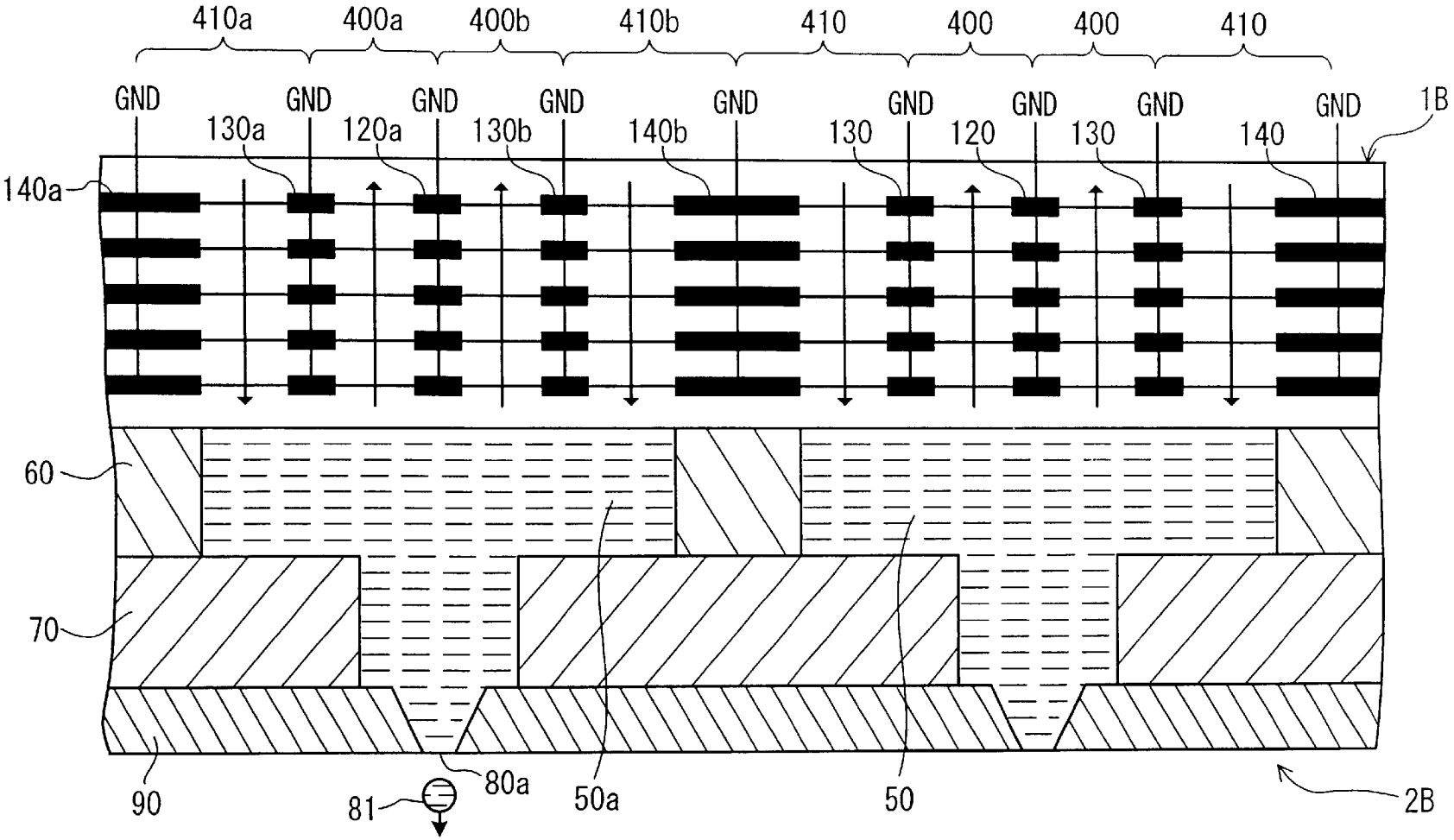
FIG. 16 is a sectional view showing the operation of the ink ejector according to the second embodiment where an ink droplet is ejected.

According to the theory of propagation of a pressure wave, when the time T has expired after the application of the drive voltage, the pressure in the ink channel 50*a* is reversed to a positive pressure. Concurrently with the reversing of the pressure, the voltage applied to the inner border electrodes 130*a*, 130*b* are reset to 0 V. Consequently, as shown in FIG. 16, the piezoelectric transducer 1B returns to its non-deformed original state and pressurizes the ink in the ink channel 50*a*. At this time, the pressure reversed to a positive pressure is combined with the pressure generated upon returning of the piezoelectric transducer 1B, and a relatively high pressure is generated in the vicinity of the nozzle 80*a* of the ink channel 50*a*. As a result, an ink droplet 81 is ejected form the nozzle 80*a*.

In the ink ejector 2B according to the second embodiment, besides two second areas 410, first areas 400 are defined for each ink channel 50 by an odd number of inner electrodes and are polarized substantially perpendicular to the opposing directions of the inner electrodes. Upon the application of a drive voltage, the two second areas 410 are deformed by a shear effect. At the same time, when the drive voltage is applied to the odd number of electrodes symmetrically with respect to the electrode at the center, electric fields are generated perpendicular to the polarization directions to deform the first areas by a shear mode symmetrically. Accordingly, the first and second areas are effectively deformed with a relatively low voltage.

In this case, because the directions of polarization as well as the directions of resultant electric fields are opposite in adjacent first and second areas, the adjacent first and second areas are deformed by a shear effect in the same direction, and thus the required deformation is achieved with a relatively low drive voltage even when the spaces between the electrodes to which the drive voltage is applied are short.

Figure 23:
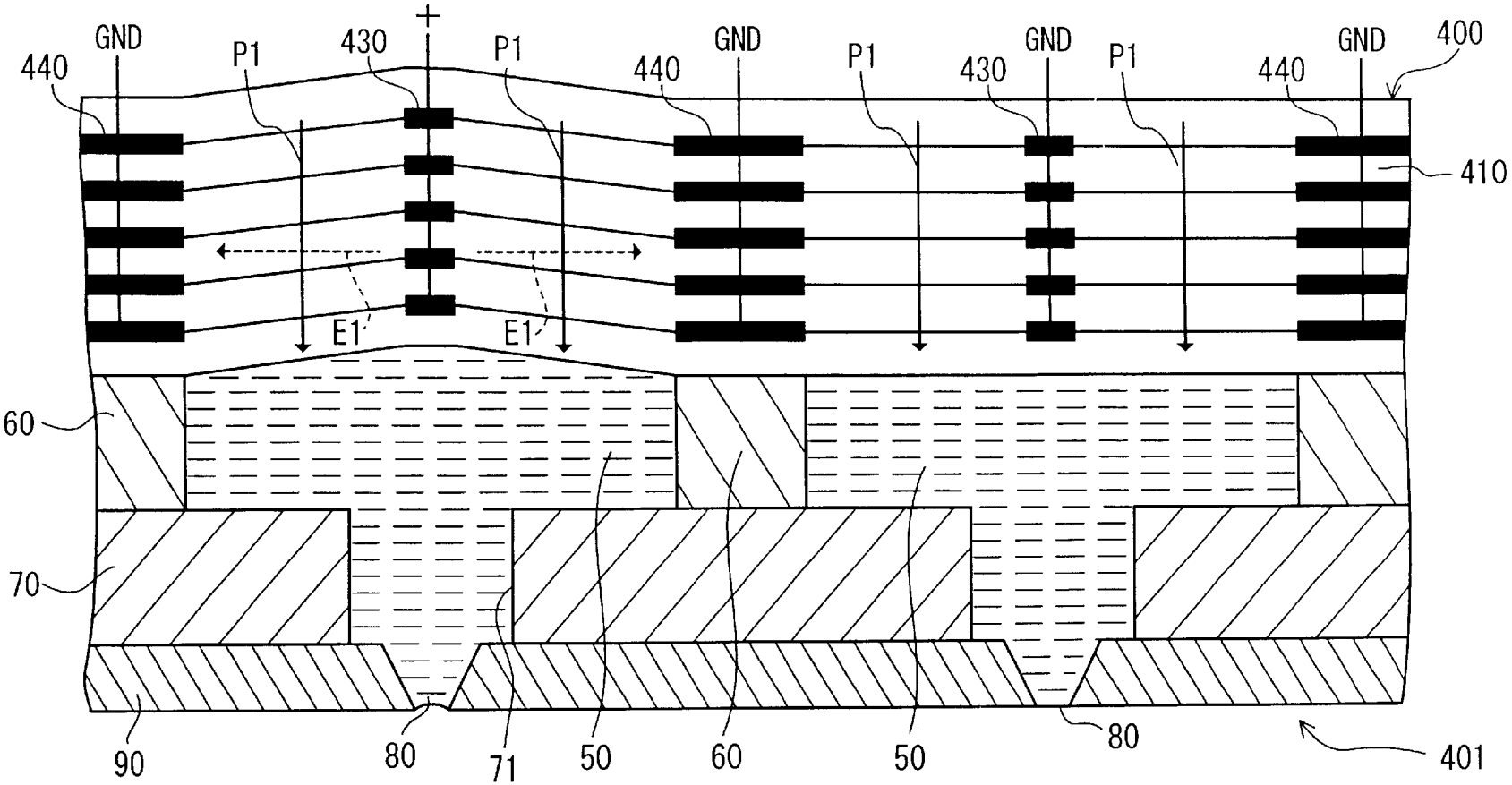
FIG.23 RELATED ART
FIG. 23 is a sectional view showing the operation of an conventional ink ejector where a piezoelectric transducer is locally deformed.
Figure 24:
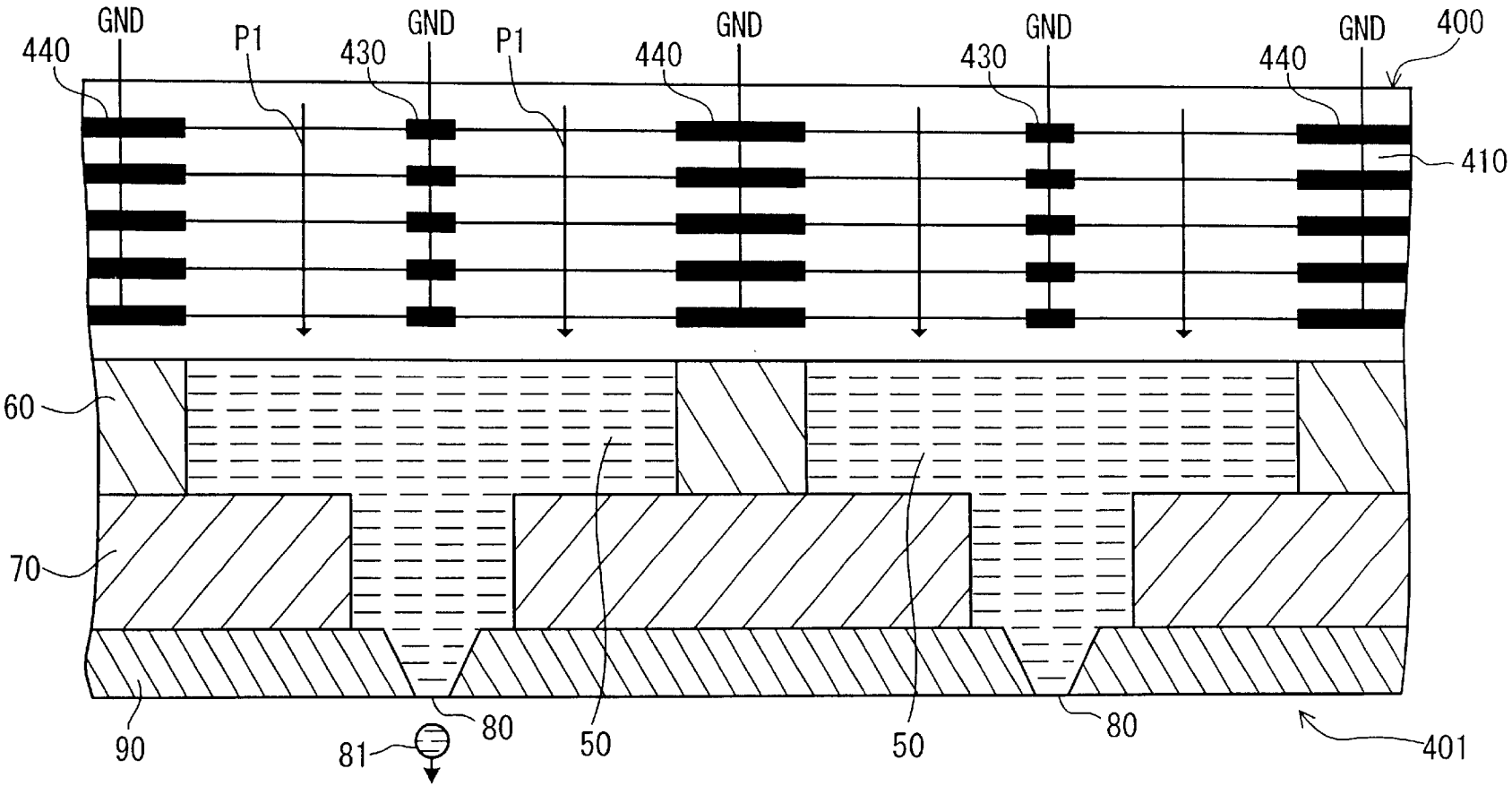
FIG.24 RELATED ART
FIG. 24 is a sectional view showing the operation of the conventional ink ejector where an ink droplet is ejected.

Further, two first areas 400 for each ink channel 50 are sandwiched by two second areas, and the spaces between the inner electrodes 140, 130, 120, 130, 140 for each ink channel 50 are less than half the spaces between the inner electrodes 440, 430, 440 for each ink channel 50 of the conventional piezoelectric ink ejector 401 of FIGS. 23, 24. Because both first and second areas 400, 410 are deformed in the same direction by a shear effect, the amount of change in the volume of the ink channel 50 substantially equals to that of the conventional piezoelectric ink ejector 401. Accordingly, the drive voltage can be lowered to about half compared to the conventional piezoelectric ink ejector 401.

Figure 17:
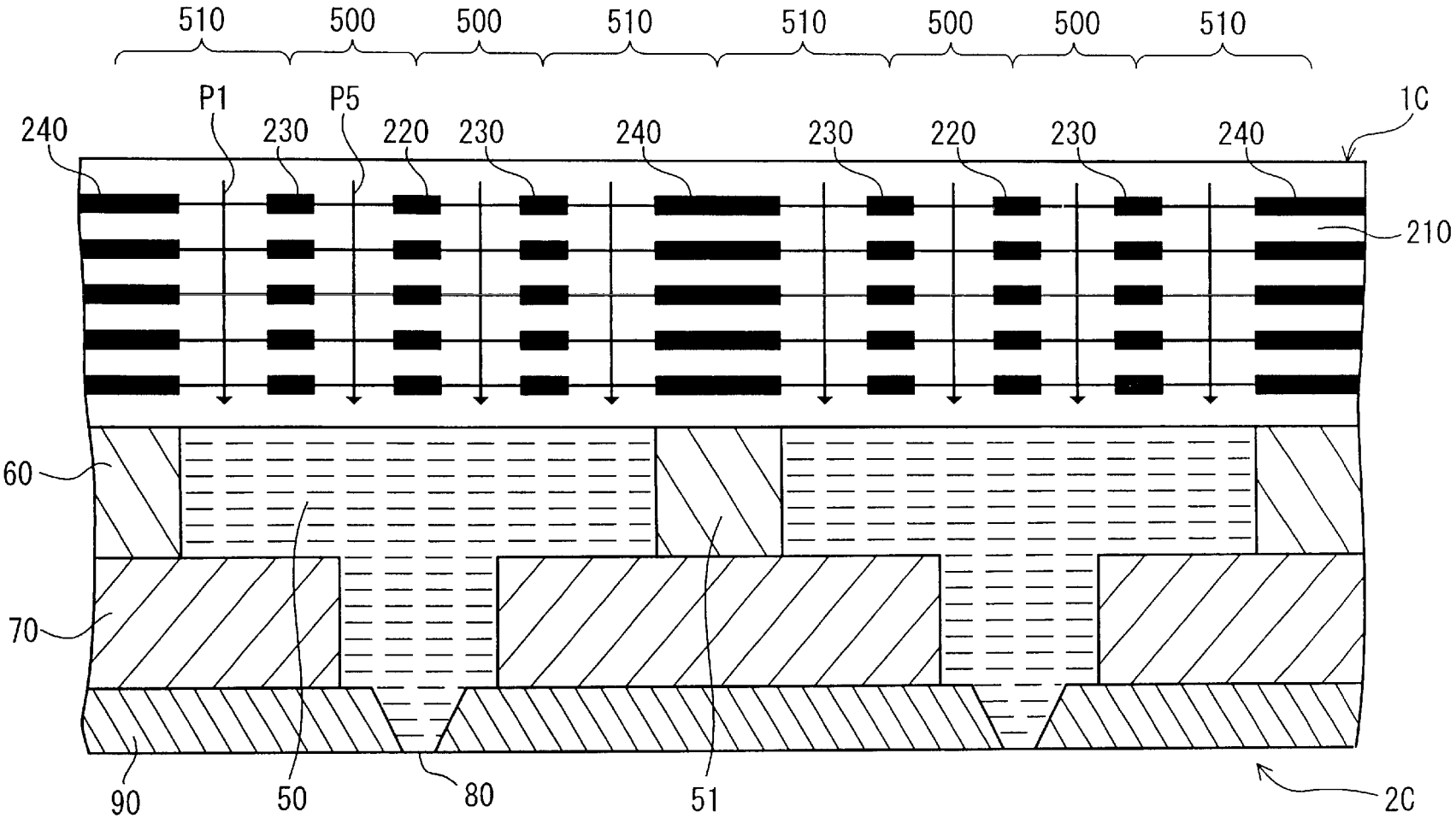
FIG. 17 is a sectional view of an ink ejector according to a third embodiment of the invention.

Referring now to FIGS. 17 thorough 22, a third embodiment of the invention will be described. FIG. 17 is a sectional view of ink channels 50 sectioned in their arrayed direction (in a right-left direction in FIG. 17). Similarly to the first and second embodiments, an ink ejector 2C includes a piezoelectric transducer 1C, an ink channel forming member 60, a spacer member 70, and a nozzle plate 90 having nozzles 80. Each ink channel 50 enclosed by the ink channel forming member 60, the spacer member 70, and the nozzle plate 90 measures 0.450 mm in width (in the right-left direction in FIG. 9) and 2.000 mm in length (in a direction perpendicular to the sheet of FIG. 17). A plurality of ink channels are arranged with 0.508 mm pitches (50 dpi) in the right-left direction in FIG. 17.

The piezoelectric transducer 1C is made of a piezoelectric ceramic material of lead zirconate titanate (PZT) group. The piezoelectric transducer 1C includes one or more piezoelectric ceramic layers 210 having a piezoelectric and electrostrictive strain effect and a plurality of spaced inner electrodes 220, 230, 240 placed along each piezoelectric ceramic layer 210.

The inner electrodes 220, 230, 240 are distinguished from each other by their positions in the width direction of an ink channel 50 (in the right-left direction in FIG. 17). Inner electrodes substantially centered over each ink channel 50 are called center electrodes 220. Inner electrodes aligned with each partition wall 51 separating adjacent two ink channels 50 are called end electrodes 240. Inner electrodes located substantially in the middle of between adjacent center and end electrodes 220, 240 are called border electrodes 230. Areas in the piezoelectric ceramic layers 210 defined by a first set of electrodes that includes an odd number of columns of electrodes (inner electrodes 230, 220, 230) are called first areas 500. Areas in the piezoelectric ceramic layers 210 defined by a second set of electrodes that includes a plurality of columns of electrodes (inner electrodes 240, 230, 230, 240) split by the first areas 500 are called second areas 510.

Thus, in the piezoelectric transducer 1C, two first areas 500 are centered over each ink channel 50, and two second areas 510 on both sides of the two first areas 500 are located near both edges of each ink channel 50.

The thickness of each piezoelectric ceramic layer 210, the total thickness of laminated piezoelectric ceramic layers 210, and the material for the inner electrodes 220, 230, 240 are the same as those in the second embodiment.

As shown in FIG. 17, the polarization direction in each first area 500 is parallel to the laminating direction of the piezoelectric ceramic layers 1C, as shown by solid arrow P5. The polarization direction in each second area 510 is parallel to the laminating direction, as shown by solid line P1, and the same as the polarization direction (shown by solid arrow P5) in each first area 500.

The piezoelectric transducer 1C according to the third embodiment is manufactured as described below.

Figure 18:
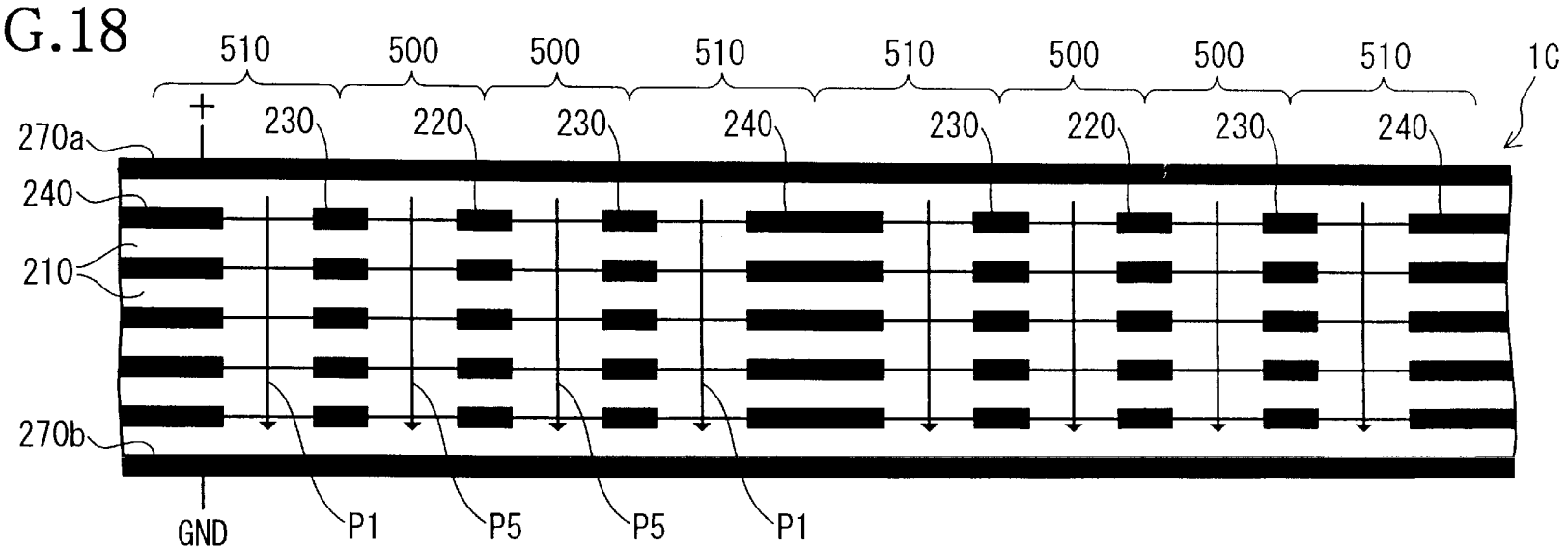
FIG. 18 is a sectional view showing polarization in the manufacturing procedure of the piezoelectric transducer for the ink ejector according to the third embodiment.

Discrete inner electrodes 220, 230, 240 are formed on the upper surface of each green sheet by screen-printing. Then, the required number of green sheets with inner electrodes 220, 230, 240 are laminated, and a green sheet without inner electrodes is stacked on the top of the laminate. The piezoelectric ceramic layers 1C thus obtained are thermally pressed, degreased, and sintered, as required. Then, as shown in FIG. 18, polarizing electrodes 270*a*, 270*b* are formed entirely on the upper and lower surfaces of the piezoelectric transducer 1C, by screen-printing or spattering.

The piezoelectric transducer 1C thus obtained is immersed in an oil bath filled with an insulating oil, such as a silicon oil, heated to a temperature of about 130° C., and an electric field of about 2.5 kV/mm is applied by a polarizing power source (not shown) between the polarizing electrodes 270*a*, 270*b*. More specifically, as shown in FIG. 18, polarization is performed by applying a positive voltage to the upper polarizing electrode 270*a* while grounding the lower polarizing electrode 270*b*. As a result, the piezoelectric transducer 1C is polarized parallel to the laminating direction, as shown by arrows P5 and P1, which are of the same direction.

Figure 19:
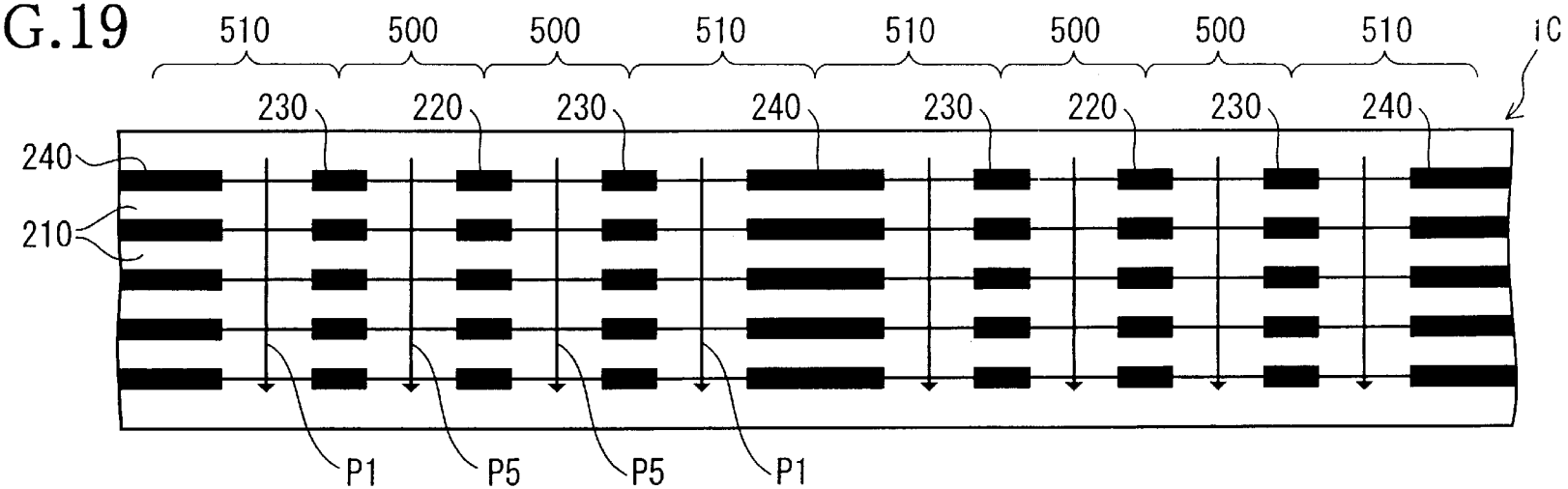
FIG. 19 is a sectional view showing a polarizing electrode removing process in the manufacturing procedure of the piezoelectric transducer for the ink ejector according to the third embodiment.

Then, as shown in FIG. 19, the polarizing electrodes 270*a*, 270*b* are removed by grinding from the upper and lower surfaces of the piezoelectric transducer 1C. Areas defined by a column of inner center electrodes 220 and two columns of inner border electrodes 230, 230 on both sides of a column of inner center electrodes 220 become the above-described first areas 500. Areas provided on both sides of the first areas 500 and each defined by a column of inner border electrodes 230 and a column of inner end electrodes 240 become the above-described second areas 510. The polarization direction P5 in each first area 500 is the same as the polarization direction P1 in each second area 510.

Thereafter, electrical connections are established for stacked inner center electrodes 220, stacked inner border electrodes 230, and stacked inner end electrodes 240 in the same manner as for the inner center, border, and end electrodes 20, 30, 40 in the first embodiment.

By integrally assembling the ink channel forming member 60, the spacer 70, and the nozzle plate 90 into the piezoelectric transducer 1C thus obtained, an ink ejector 2C, shown in FIG. 17, is constructed.

Figure 20:
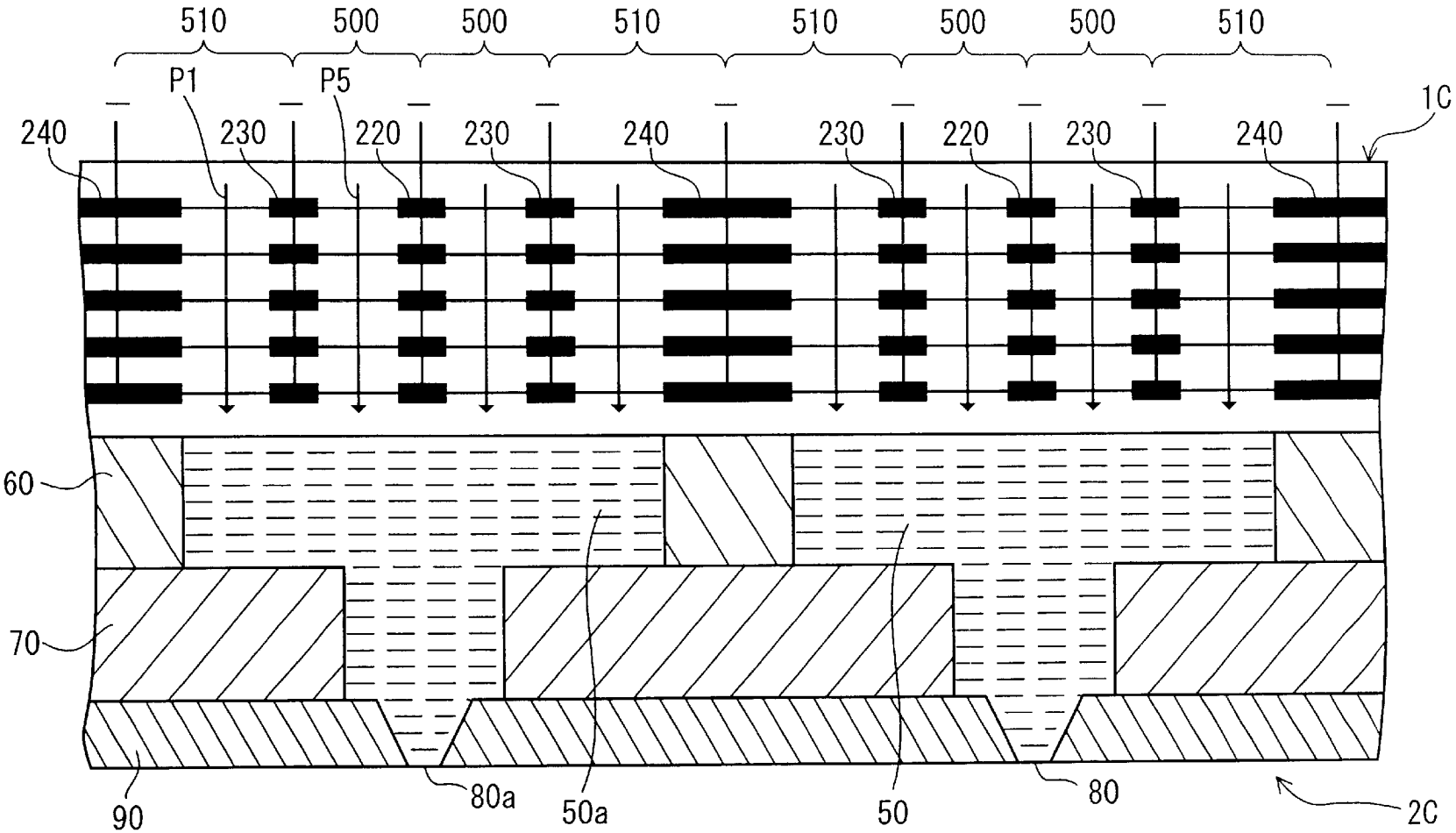
FIG. 20 is a sectional view showing the operation of the ink ejector according to the third embodiment where the ink ejector is in the initial state.

The operation of the ink ejector 2C thus structured will be described. In the initial state, as shown in FIG. 20, a negative voltage (of −15 V, for example) is uniformly applied to all the inner electrodes 220, 230, 240 and the ink channels 50 are filled with ink.

Figure 21:
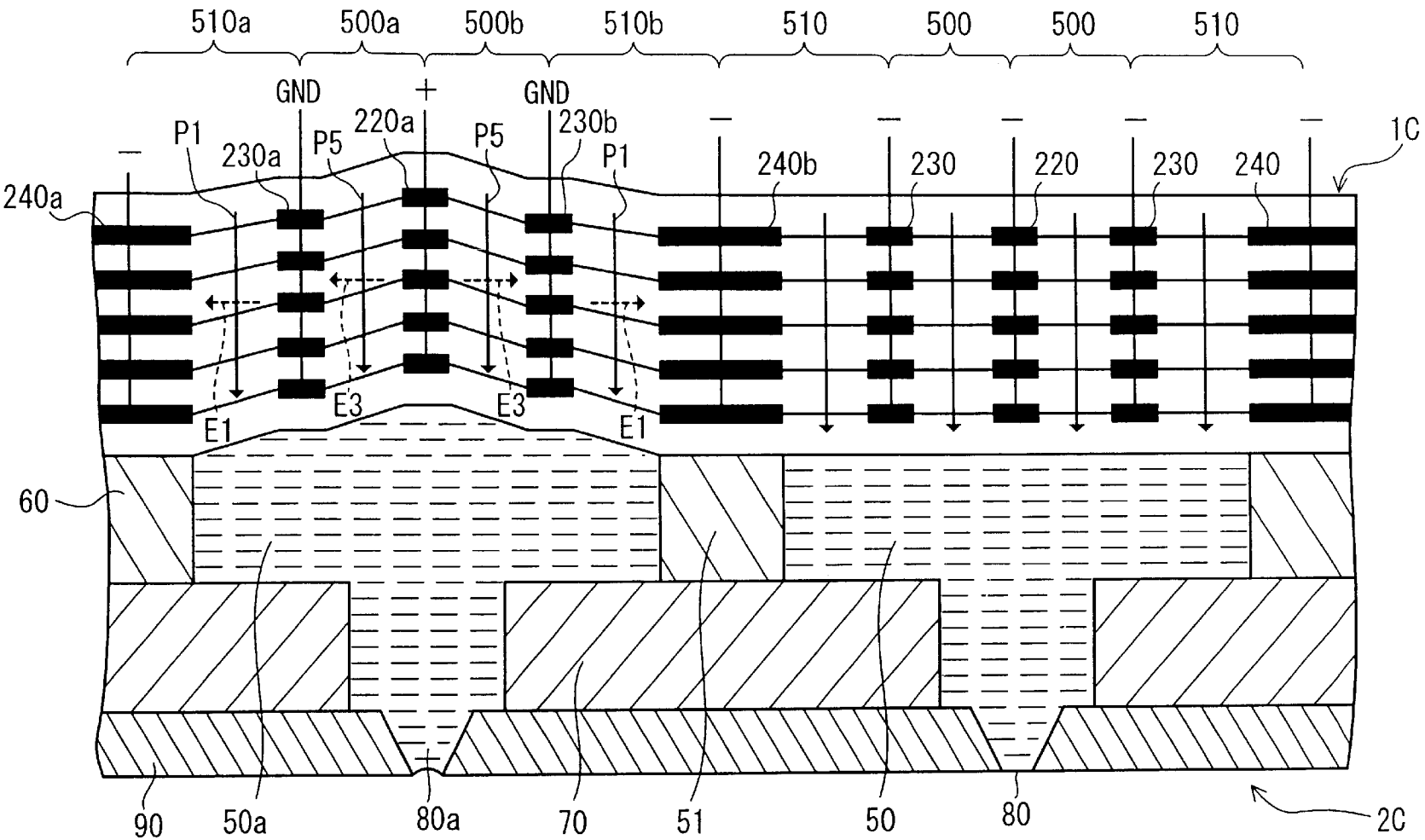
FIG. 21 is a sectional view showing the operation of the ink ejector according to the third embodiment where the piezoelectric transducer is locally deformed.

As shown in FIG. 21, when an ink droplet is ejected from a nozzle 80*a* connected to a selected ink channel 50*a* according to a predetermined print data, a drive voltage (of 15 V, for example) is applied to inner center electrodes 220*a* centered over the selected ink channel 50*a* while inner border electrodes 230*a*, 230*b* provided over the selected ink channel 50*a* are grounded. At this time, an electric field is generated, as shown by dashed arrow E3, perpendicular to the polarization direction P5 in each of first areas 500*a*, 500*b* by the inner center electrodes 220*a* and the inner border electrodes 230*a*, 230*b*. An electric field is also generated, as shown by dashed arrow E1, perpendicular to the polarization direction P1 in each of second areas 510*a*, 510*b* between the inner border electrodes 230*a* and inner end electrodes 240*a* and between the inner border electrodes 230*b* and inner end electrodes 240*b*, respectively. As a result, an electric field perpendicular to the polarization direction is applied to each of the first and second areas 500*a*, 500*b*, 510*a*, 510*b* defined over the ink channel 50*a* to cause each of these areas to deform upwardly in FIG. 15 by a piezoelectric shear effect. In this case, electric fields E3, E1 are directed toward both edges of the ink channel 50*a*, symmetrically with respect to the inner center electrodes 220*a*. Thus, each of the second areas 510*a*, 510*b* is deformed, by a piezoelectric and electrostrictive shear effect, into a parallelogram shape and shifted outwardly from the ink channel 50*a* to increase the volume of the ink channel 50*a*. In other words, upon the application of the electric field E1 perpendicular to the polarization direction P1 to each of the second areas 510*a*, 510*b*, the second areas 510*a*, 510*b* are deformed to shift the inner border electrodes 230*a*, 203*b* obliquely with respect to the inner end electrodes 240*a*, 240*b*, thereby shifting the first areas 500*a*, 500*b* away from the nozzle 80*a*. At the same time, the first areas 500*a*, 500*b* defined by the inner center electrodes 220*a* and the inner border electrodes 230*a*, 230*b* are deformed, symmetrically with respect to the inner center electrodes 220*a*, into parallelogram shapes to shift the inner center electrodes 220*a* outwardly from the ink channel 50*a*, thereby increasing the volume of the ink channel 50*a*.

At this time, the pressure in the ink channel 50*a* is reduced. By maintaining such a state for a period of time T required for a pressure wave generated to propagate along the ink channel 50*a*, ink is supplied from the ink supply source (not shown).

The one-way propagation time T represents a time required for a pressure wave in the ink channel 50*a* to propagate longitudinally (in a direction perpendicular to the sheet of FIG. 21) along the ink channel 50*a*, and is given by an expression T=L/Z, where L is a length of the ink channel 50*a* and Z is a speed of sound in the ink in the ink channel 50*a*.

Figure 22:
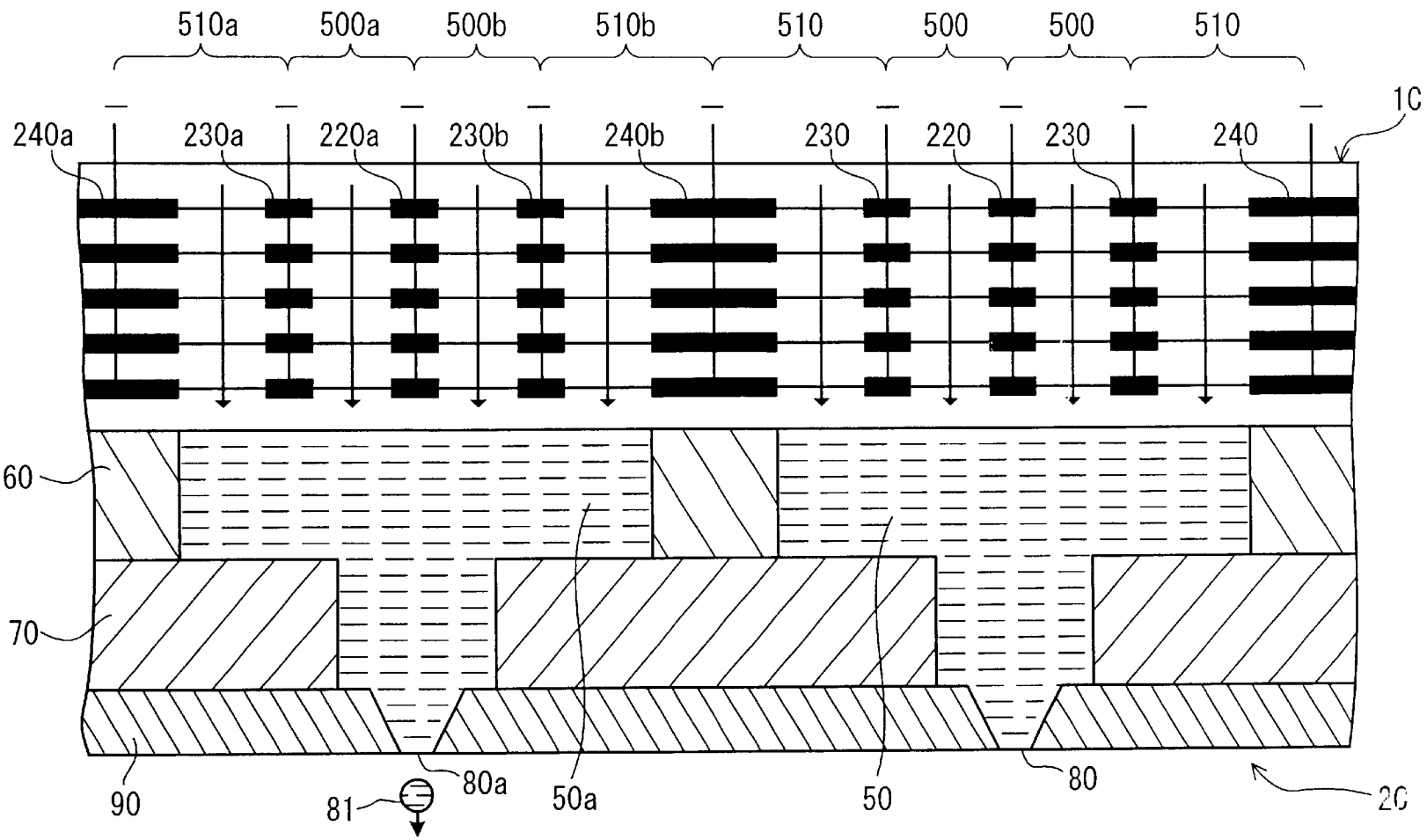
FIG. 22 is a sectional view showing the operation of the ink ejector according to the third embodiment where an ink droplet is ejected.

According to the theory of propagation of a pressure wave, when the time T has expired after the application of the drive voltage, the pressure in the ink channel 50*a* is reversed to a positive pressure. Concurrently with the reversing of the pressure, a negative voltage (of −15 V, for example) is applied to all the inner electrodes 220, 230, 240. Consequently, as shown in FIG. 22, the piezoelectric transducer 1C returns to its non-deformed original state and pressurizes the ink in the ink channel 50*a*. At this time, the pressure reversed to a positive pressure is combined with the pressure generated upon returning of the piezoelectric transducer 1C, and a relatively high pressure is generated in the vicinity of the nozzle 80*a* of the ink channel 50*a*. As a result, an ink droplet 81 is ejected form the nozzle 80*a*.

In the ink ejector 2C according to the third embodiment, besides two second areas 510, first areas 500 are defined for each ink channel 50 by an odd number of inner electrodes and, upon the application of a drive voltage, the two second areas 510 are deformed by a shear effect and the first areas 500 are deformed by a shear effect symmetrically. In this case, because the directions of polarization as well as the directions of resultant electric fields are the same in adjacent first and second areas, the adjacent first and second areas are deformed by a shear effect in the same direction. Thus, the required deformation is achieved with a relatively low drive voltage even when the spaces between the electrodes to which the drive voltage is applied are short.

Further, two first areas 500 for each ink channel 50 are sandwiched by two second areas 510, and the spaces between the inner electrodes 240, 230, 220, 230, 240 for each ink channel 50 are less than half the spaces between the inner electrodes 440, 430, 440 for each ink channel 50 of the conventional ink ejector 401 of FIGS. 23, 24. Because both first and second areas 400, 410 are deformed in the same direction by a shear effect, the amount of change in the volume of the ink channel 50 substantially equals to that of the conventional ink ejector 401. Accordingly, the drive voltage can be lowered to about half compared to the conventional ink ejector 401.

Further, in the third embodiment, use of a low-voltage power source is allowed by grounding the inner border electrodes 230*a*, 230*b*, applying a positive voltage to the inner center electrodes 220*a* and applying a negative voltage to the inner end electrodes 240*a*, 240*b*.

In the above-described first, second, and third embodiments, when a drive voltage is applied to inner electrodes in the piezoelectric transducer 1A, 1B, 1C to eject ink from an ink channel 50, two second areas sandwiching two first area are obliquely deformed by a shear effect to unidirectionally shift the two first areas, thereby increasing the volume of the ink channel 50. At the same time, the two first areas are deformed to increase a space created between the two second areas to further increase the volume of the ink channel 50. Accordingly, ink is ejected effectively with a relatively low voltage.

The piezoelectric transducer 1A, 1B, 1C is manufactured by grinding its upper and lower surfaces after undergoing polarization. Accordingly, distortion due to polarization is eliminated from the piezoelectric transducer 1A, 1B, 1C and uniform motion of the piezoelectric transducer 1A, 1B, 1C and better contact with parts to be mounted thereon are ensured.

In addition, inner electrodes in the piezoelectric transducer 1A, 1B, 1C are sandwiched between adjacent piezoelectric ceramic layers and stacked in the laminating direction of piezoelectric ceramic layers. Inner electrodes of each stack have the same potential when driven. Stacks of inner electrodes can be adjusted in height depending on the thickness of a piezoelectric ceramic layer and the number of laminated piezoelectric ceramic layers. The thickness of an inner electrode can also be adjusted, independently of the thickness of a piezoelectric ceramic layer. Additionally, because inner electrodes are sandwiched by adjacent layers, a breakdown of the piezoelectric transducer 1A, 1B, 1C due to electric discharge between electrodes of opposite polarity is reliably prevented.

When the piezoelectric transducer 1A, 1B, 1C is placed across a plurality of ink channels 50 to change the volume of an selected ink channel 50 for ink ejection, the above-described two first areas are centered over each ink channel and two second areas are placed near both edges of each ink channel 50. First and second areas, arranged at short intervals over each ink channel, are deformed simultaneously and effectively with a relatively low voltage and generate the pressure required for ink ejection. Thus, the cost of a driving power source can be reduced. Additionally, because inner electrodes to be driven are sandwiched between adjacent piezoelectric ceramic layers, they are insulated from the ink in the ink channels and prevented from corroding.

Further, inner end electrodes 40, 140, 240, which partially define a second area, are aligned with each partition wall 51 separating adjacent ink channels 50. For each ink channel 50, deformable areas, including two first areas and two second areas sandwiching the two first area, are provided. Accordingly, uniform deformation is achieved in each ink channel 50 and stable performance is ensured in the ink ejector 2A, 2B, 2C.

Further, when a drive voltage is applied to inner electrodes in the piezoelectric transducer 1A, 1B, 1C to eject ink from an ink channel 50, two second areas sandwiching two first area are deformed to increase the volume of the ink channel 50 and, at the same time, two first areas are deformed between the two second areas to further increase the volume of the ink channel 50. Accordingly, ink is ejected effectively with a relatively low voltage.

In the above-described embodiments, inner border electrodes 30, 130, 230 commonly partially define each first area 300, 400, 500 and each second area 310, 410, 510, which are adjacent to each other. Inner border electrodes 30, 130, 230 may be divided into two to separately partially define each first area 300, 400, 500 and each second area 310, 410, 450. However, common and undivided inner border electrodes 30, 130, 230 allow first and second areas to be close to each other and make the piezoelectric transducer 1A, 1B, 1C smaller. Additionally, upon the application of a drive voltage to common inner border electrodes 30, 130, 230, first and second areas are simultaneously deformed. Similarly, inner end electrodes 40, 140, 240 commonly define two second areas 310, 410, 510 across adjacent ink channels 50. Further, inner center electrodes 20, 120, 220 are used, without being divided into two, to define two first areas 300, 400, 500 that are symmetrical with respect to the inner center electrodes 20, 120, 220. Such arrangement of inner electrodes makes the piezoelectric transducer 1A, 1B, 1C much smaller.

The width of an ink channel in the array direction, the pitch of ink channels, the number of laminated piezoelectric layers, and the position of each inner electrode can be changed as required.

Also, inner electrodes can be led out to the top surface or any side surface of the piezoelectric transducer, and outer electrodes can be mounted on the top surface or any side surface thereof as long as inner and outer electrodes do not interfere with each other.

Polarizing electrodes can be simply attached to and removed from the piezoelectric transducer as in the first embodiment, or can be formed thereon by screen-printing or spattering and removed therefrom by grinding as in the second and third embodiments.

While the invention has been described with reference to the specific embodiments, the description of the embodiments is illustrative only and is not to be construed as limiting the scope of the invention. Various other modifications and changes may be occur to those skilled in the art without departing from the spirit and scope of the invention.

What is claimed is:

1. A piezoelectric transducer, comprising:

a piezoelectric ceramic member; and a plurality of electrodes spaced along the piezoelectric ceramic member, the plurality of electrodes including:

a first set of electrodes defining therebetween at least one first area; and a second set of electrodes split by the at least one first area and defining second areas, one on each side of the at least one first area, the second areas being polarized, in a first polarization direction, substantially perpendicular to an opposing direction of electrodes of the second set of electrodes, wherein upon application of a drive voltage to the first and second sets of electrodes, a first electric field is generated in each of the second areas substantially perpendicular to the first polarization direction, each of the second areas is obliquely deformed by a piezoelectric shear effect to unidirectionally shift the at least one first area, and the at least one first area is deformed to increase a space created between the second areas deformed.

2. The piezoelectric transducer according to claim 1, wherein the at least one first area is polarized, in a second polarization direction, in an opposing direction of electrodes of the first set of electrodes and, upon application of the drive voltage, a second electric field is generated in the at least one first area parallel to the second polarization direction to cause the at least one first area to deform by a longitudinal effect between the second areas deformed.

3. The piezoelectric transducer according to claim 2, wherein the at least one first area comprises an even number of first areas that are symmetrically polarized.

4. The piezoelectric transducer according to claim 1, wherein bordering electrodes directly separating the at least one first area and the second areas belong to the first set of electrodes as well as the second set of electrodes and commonly partially define the at least one first area and the second areas.

5. The piezoelectric transducer according to claim 1, wherein the at least one first area comprises a plurality of first areas defined by the first set of electrodes comprising an odd number of electrodes, the plurality of first areas are polarized, in a second polarization direction, substantially perpendicular to the opposing direction of electrodes of the first set of electrodes, and upon application of the drive voltage, a second electric field is generated in each of the first areas perpendicular to the second polarization direction to cause each of the first areas to deform by a piezoelectric shear effect.

6. The piezoelectric transducer according to claim 5, wherein bordering electrodes directly separating the first areas and the second areas belong to the first set of electrodes as well as the second set of electrodes and commonly applies the drive voltage to the first and second areas, the first and second areas are polarized in opposite directions, and the second and first electric fields are generated in the first and second areas symmetrically with respect to the bordering electrodes.

7. The piezoelectric transducer according to claim 5, wherein bordering electrodes, directly separating the first areas and the second areas, belong to the first set of electrodes as well as the second set of electrodes and commonly applies the drive voltage to the first and second areas, the first and second areas are polarized in the same direction, and electric fields are generated in the first and second areas in the same direction.

8. The piezoelectric transducer according to claim 1, wherein the piezoelectric transducer has grounded upper and lower surfaces.

9. The piezoelectric transducer according to claim 1, wherein the piezoelectric ceramic member comprises a plurality of laminated piezoelectric ceramic layers, electrodes of the first set of electrodes and the electrodes of the second set of electrodes are sandwiched between the piezoelectric ceramic layers and stacked in a laminating direction, and the electrodes in each stack are electrically connected to one another and have the same potential when the drive voltage is applied thereto.

10. An ink ejector, comprising:

an ink channel forming member having partition walls that define ink channels filled with ink;

a nozzle connected to a corresponding one of the ink channels; and a piezoelectric transducer including:

a piezoelectric ceramic member extending across the ink channels; and a plurality of electrodes spaced along the piezoelectric ceramic member, the plurality of electrodes including:

a first set of electrodes provided for each ink channel to define therebetween at least one first area and substantially centered over each of the ink channels; and a second set of electrodes provided for each ink channel and split by the at least one first area to define second areas, one on each side of the at least one first area, the second areas being located near both edges of each of the ink channels and polarized, in a first polarization direction, substantially perpendicular to an opposing direction of electrodes of the second set of electrodes, wherein upon application of a drive voltage to the first and second sets of electrodes provided for a selected one of the ink channels, a first electric field is generated in each of the second areas substantially perpendicular to the first polarization direction, each of the second areas is obliquely deformed by a piezoelectric shear effect to unidirectionally shift the at least one first area, and the at least one first area is deformed to increase a space created between the second areas deformed, thereby changing a volume of the selected one of the ink channels to cause ink ejection from the nozzle of the selected ink channel.

11. The ink ejector according to claim 10, wherein, among the second set of electrodes that define a second area, electrodes that do not border the at least one first area are aligned with the partition walls that separate adjacent ones of the ink channels.

12. The ink ejector according to claim 10, wherein upon application of the drive voltage, the second areas are deformed to increase the volume of the selected ink channel and the at least one first area is deformed between the second areas to further increase the volume of the selected ink channel.

13. The ink ejector according to claim 10, wherein the at least one first area is polarized, in a second polarization direction, in an opposing direction of electrodes of the first set of electrodes, and upon application of the drive voltage, a second electric field is generated in the at least one first area parallel to the second polarization direction to cause the at least one first area to deform by a longitudinal effect between the second areas deformed.

14. The ink ejector according to claim 10, wherein the at least one first area comprises an even number of first areas that are symmetrically polarized.

15. The ink ejector according to claim 10, wherein bordering electrodes directly separating the at least one first area and the second areas belong to the first set of electrodes as well as the second set of electrodes and commonly partially define the at least one first area and the second areas.

16. The ink ejector according to claim 10, wherein the at least one first area comprises a plurality of first areas defined by the first set of electrodes comprising an odd number of electrodes, the plurality of first areas are polarized, in a second polarization direction, substantially perpendicular to the opposing direction of electrodes of the first set of electrodes, and upon application of the drive voltage, a second electric field is generated in each of the first areas perpendicular to the second polarization direction to cause each of the first areas to deform by a piezoelectric shear effect.

17. The ink ejector according to claim 16, wherein bordering electrodes directly separating the first areas and the second areas belong to the first set of electrodes as well as the second set of electrodes and commonly applies the drive voltage to the first and second areas, the first and second areas are polarized in opposite directions, and the second and first electric fields are generated in the first and second areas symmetrically with respect to the bordering electrodes.

18. The ink ejector according to claim 16, wherein bordering electrodes directly separating the first areas and the second areas belong to the first set of electrodes as well as the second set of electrodes and commonly applies the drive voltage to the first and second areas, the first and second areas are polarized in the same direction, and electric fields are generated in the first and second areas in the same direction.

19. The ink ejector according to claim 10, wherein the piezoelectric transducer has grounded upper and lower surfaces.

20. The ink ejector according to claim 10, wherein the piezoelectric ceramic member comprises a plurality of laminated piezoelectric ceramic layers, electrodes of the first set of electrodes and the electrodes of second set of electrodes are sandwiched between the piezoelectric ceramic layers and stacked in a laminating direction, and the electrodes in each stack are electrically connected to one another and have the same potential when the drive voltage is applied thereto.

21. An ink ejector, comprising:

an ink channel forming member having partition walls that define ink channels filled with ink;

a nozzle connected to a corresponding one of the ink channels; and a piezoelectric transducer including:

a piezoelectric ceramic member extending across the ink channels; and a plurality of inner electrodes spaced along the piezoelectric ceramic member and including a first electrode substantially centered over each of the ink channels, two second electrodes located over each of the ink channels to sandwich the first electrode, and two third electrodes aligned with the partition walls defining each of the ink channels, the first electrode and the two second electrodes defining two first areas, and the two second electrodes and the two third electrodes defining two second areas polarized in polarization directions substantially perpendicular to opposing directions of the plurality of inner electrodes, wherein the two first areas are sandwiched, over each of the ink channels, by the two second areas, and wherein upon application of a drive voltage to the first, second, and third electrodes for a selected one of the ink channels, resultant electric fields cause the two second areas to deform by a shear effect to increase a volume of the selected ink channel and resultant electric fields cause the two first areas to deform to further increase the volume of the selected ink channel, thereby causing ink ejection from the nozzle of the selected ink channel.

22. The ink ejector according to claim 21, wherein the piezoelectric ceramic member comprises a plurality of laminated layers, the plurality of inner electrodes are sandwiched between the layers, and the first, second, and third electrodes placed on one of the layers are respectively aligned with the first, second, and third electrodes placed another one of the layers.

23. The ink ejector according to claim 22, wherein polarization directions of the two first areas defined over each of the ink channels in each of the layers are parallel to the opposing directions of the plurality of inner electrodes and symmetrical with respect to the first electrode, and upon application of the drive voltage, resultant electric fields cause the two first areas to expand by a longitudinal effect toward the two second electrodes, parallel to the polarization directions.

24. The ink ejector according to claim 22, wherein polarization directions of the two first areas defined over each of the ink channels in each of the layers are substantially perpendicular to the opposing directions of the plurality of inner electrodes, and upon application of the drive voltage, resultant electric fields cause the two first areas to deform by a piezoelectric shear effect.

25. The ink ejector according to claim 24, wherein in adjacent ones of the first and second areas defined over each of the ink channels in each one of the layers, the polarization directions are opposite and directions of the resultant electric fields are opposite.

26. The ink ejector according to claim 24, wherein in adjacent ones of the first and second areas defined over each of the ink channels in each one of the layers, the polarization directions are the same and directions of the resultant electric fields are the same.

27. The ink ejector according to claim 21, wherein each of the two third electrodes is shared by two adjacent ones of the ink channels.

28. The ink ejector according to claim 22, wherein the piezoelectric transducer further includes a plurality of outer electrodes that are provided on an external surface thereof and electrically connected to associated ones of the first, second, and third electrodes aligned in a laminating direction of the layers.

29. The ink ejector according to claim 22, wherein a bottom one of the layers of the piezoelectric ceramic member is attached to the ink channel forming member.

* * * * *